US009731849B1

(12) United States Patent
Ito et al.

(10) Patent No.: US 9,731,849 B1
(45) Date of Patent: Aug. 15, 2017

(54) PAPER SHEET BUNDLING APPARATUS WITH CONTROLLED PRINTING

(75) Inventors: Osamu Ito, Hyogo (JP); Tsuyoshi Hodatsu, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 647 days.

(21) Appl. No.: 13/592,384

(22) Filed: Aug. 23, 2012

Related U.S. Application Data

(60) Provisional application No. 61/526,766, filed on Aug. 24, 2011.

(51) Int. Cl.

| | |
|---|---|
| ***B65B 27/08*** | (2006.01) |
| ***B65B 61/02*** | (2006.01) |
| ***G07D 11/00*** | (2006.01) |
| ***B41J 3/407*** | (2006.01) |

(52) U.S. Cl.
CPC ..... *B65B 27/08* (2013.01); *B41J 3/4075* (2013.01); *B65B 61/025* (2013.01); *G07D 11/0084* (2013.01)

(58) Field of Classification Search
CPC ..... G07D 11/0084; G07F 7/04; B65B 27/08; B65B 61/025; B65B 61/26; B41J 3/4075; B41J 3/38; B41J 3/393; B41J 29/40
USPC ..... 53/411; 358/1.18
See application file for complete search history.

(56) References Cited

U.S. PATENT DOCUMENTS 4,661,001 A * 4/1987 Takai ..... G01G 19/415 400/103
5,012,932 A * 5/1991 Omura et al. ..... 209/534
6,129,467 A * 10/2000 Toyosawa ..... B41J 11/008 400/61
6,919,967 B1 * 7/2005 Pentecost ..... G06F 17/212 235/375
7,367,169 B2 * 5/2008 Katsumata ..... 53/64
7,604,425 B2 * 10/2009 Otsuka ..... 400/615.2
2004/0003980 A1 * 1/2004 Hallowell et al. ..... 194/206
2005/0060956 A1 * 3/2005 Yui ..... B65B 27/08 53/399
2006/0269344 A1 * 11/2006 Zhang ..... B41J 3/46 400/71
2007/0217852 A1 * 9/2007 Handa ..... B41J 11/008 400/615.2
2009/0229950 A1 * 9/2009 Nakamoto ..... G07D 5/00 194/302
2011/0077770 A1 * 3/2011 Ito ..... 700/218
2011/0125313 A1 * 5/2011 Hodatsu et al. ..... 700/223

FOREIGN PATENT DOCUMENTS

WO WO 2010/103619 A1 9/2010

* cited by examiner

*Primary Examiner* — Stephen F Gerrity
*Assistant Examiner* — Joshua Kotis
(74) *Attorney, Agent, or Firm* — Renner, Kenner, Greive, Bobak, Taylor & Weber

(57) ABSTRACT

A banknote bundling apparatus includes a hopper that receives banknotes, a recognition unit that recognizes a banknote kind of the banknotes received by the hopper, a stacking unit in which bundling-object-banknotes are stacked based on the banknote kind recognized by the recognition unit, a bundling unit that forms a banknote bundle by bundling with a bundling tape the bundling-object-banknotes stacked in the stacking unit when the bundling-object-banknotes stacked in the stacking unit reaches a predetermined number, and a printing unit that prints information on the bundling tape to be used by the bundling unit.

13 Claims, 23 Drawing Sheets

DURING BUNDLING PREPARATION

DURING SETTING OF BUNDLING-OBJECT-BANKNOTES

DURING DETACHMENT OF PRE-BUNDLING TRANSPORT UNIT

DURING TEMPORARY TIGHTENING

DURING ACTUAL TIGHTENING

DURING CLENCHING

PAPER SHEET BUNDLING APPARATUS WITH CONTROLLED PRINTING

CROSS-REFERENCE TO RELATED APPLICATION

This application claims priority of provisional U.S. Application No. 61/526,766 filed Aug. 24, 2011, which is incorporated herein by reference.

TECHNICAL FIELD

The present invention relates to a paper-sheet bundling apparatus that can bundle a predetermined number of paper sheets with a bundling tape and print information relating to the paper sheets on the bundling tape. More particularly, the present invention relates to a paper-sheet bundling apparatus that can print information on the bundling tape situated on one surface of the bundled paper sheets.

BACKGROUND ART

As a conventional technology for printing information on a bundling tape used for bundling paper sheets, for example, a banknote bundling apparatus that prints information, such as, a bundled date, is disclosed in International Publication No. 2010/103619. In this banknote bundling apparatus, deposited banknotes are recognized, and only the banknotes of a specific kind regarded as bundling object are stacked in a bundling-side stacking unit as bundling-object-banknotes. When a predetermined number of the bundling-object-banknotes have been stacked, the bundling-object-banknotes are bundled with the bundling tape. Before bundling the banknotes, information, such as, a bundled date and a bank name, are printed on the bundling tape. Consequently, in such a banknote bundle, the bundled date, etc., can be confirmed from the information printed on the bundling tape.

However, in the conventional technology, the printed information spans over multiple surfaces of the bundling tape wrapped around the banknote bundle from an upper surface thereof to a bottom surface thereof via a side surface thereof. Consequently, all those surfaces of the bundling tape need to be viewed to confirm the entire information. Furthermore, a considerable amount of time is required if a lot of information is to be printed on the bundling tape.

SUMMARY OF THE INVENTION

It is an object of the present invention to provide a solution to the problems in the conventional technology described above by providing a paper-sheet bundling apparatus that can print information relating to paper sheets in a short time on a predetermined printing area on a bundling tape so that the information can be obtained from a single surface of a paper sheet bundle, and in which it is possible to easily set the information to be printed on the bundling tape.

According to an aspect of the present invention, a paper-sheet bundling apparatus includes a bundling unit that forms a paper sheet bundle by bundling a predetermined number of bundling-object paper sheets with a bundling tape, a variable-information setting unit that enables setting information relating to an operator of the apparatus, etc., as variable information using a display unit and an operation unit, and a printing unit that prints on the bundling tape the variable information set by the variable-information setting unit by using a printer and fixed information, such as, a bank name, by using a stamp. The printing unit prints the variable information and the fixed information on the bundling tape situated on one surface of the paper sheet bundle. Consequently, the information including the variable information and the fixed information can be viewed on a single surface of the bundling tape wrapped around the paper sheet bundle.

DETAILED DESCRIPTION OF THE INVENTION

A paper-sheet bundling apparatus according to the present invention can bundle paper sheets, such as, banknotes, gift vouchers, and valuable securities, with a bundling tape, and print information relating to the paper sheets on the bundling tape. In the following explanation, as a processing object, banknotes are presented as an example of paper sheets. Furthermore, a banknote sorting and bundling apparatus that subjects the banknotes to a sorting and stacking process and a bundling process is presented as an example. An embodiment of the present invention is explained in detail below with reference to the accompanying drawings.

Figure 1:
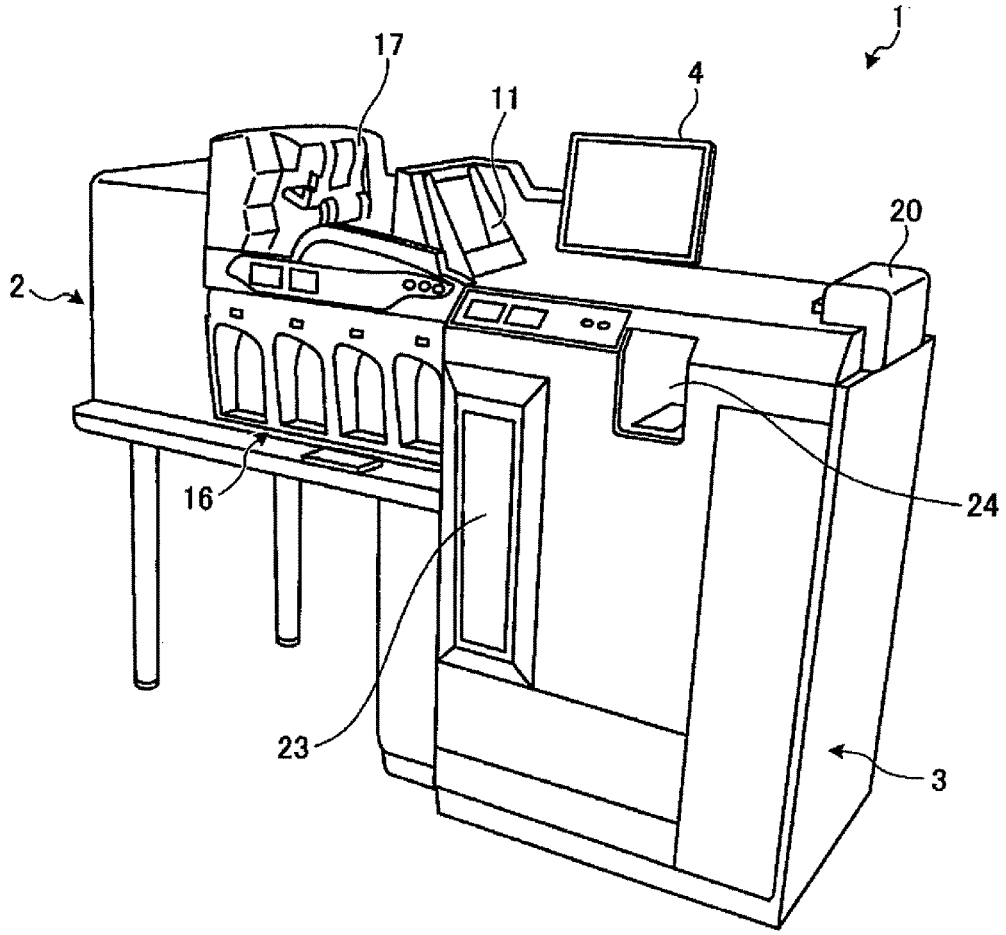
FIG. 1 is a perspective view of an outer appearance of a banknote sorting and bundling apparatus according to an embodiment of the present invention.
Figure 2:
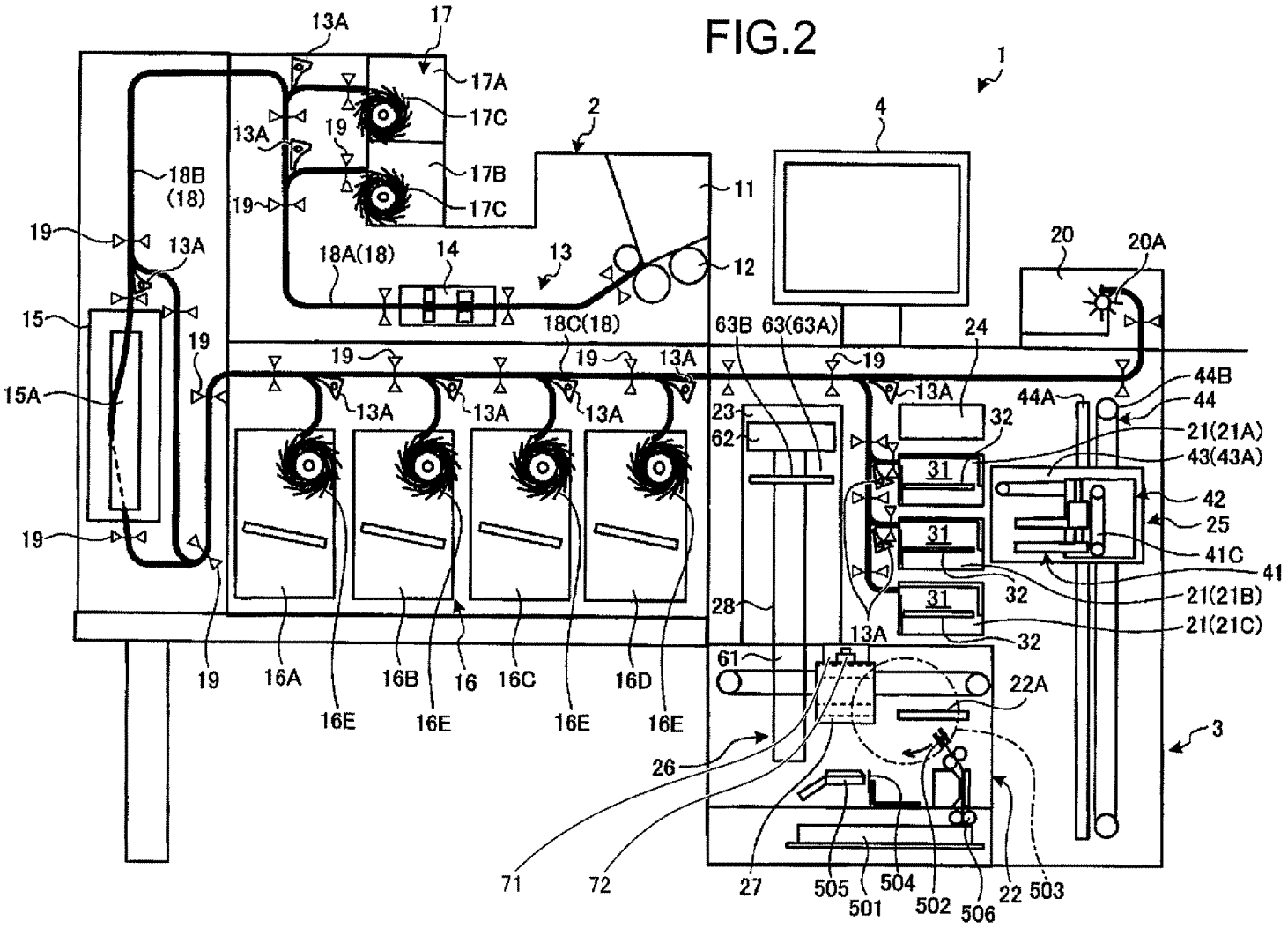
FIG. 2 is a conceptual drawing of internal parts of the banknote sorting and bundling apparatus.

FIG. 1 is a perspective view of an outer appearance of the banknote sorting and bundling apparatus according to the present embodiment. FIG. 2 is a drawing for explaining an overview of internal structure of the banknote sorting and bundling apparatus.

A banknote sorting and bundling apparatus 1 is capable of accepting banknotes of deposit transaction continuously. The banknote sorting and bundling apparatus 1 includes a banknote handling apparatus 2 that sorts and stacks the deposited banknotes based on banknote kind and counts the number of deposited banknotes by banknote kind, a banknote bundling apparatus 3 that bundles a predetermined number of banknotes, for example, every one hundred banknotes, of a specific banknote kind sorted by the banknote handling apparatus 2, and a display unit 4 that displays various information such as a counting result.

The banknote handling apparatus 2 is explained below. The banknote handling apparatus 2 includes a hopper unit 11 that is used to deposit banknotes of the transaction into the apparatus, a feeding unit 12 that feeds the banknotes, one by one, deposited in the hopper unit 11, a banknote transport unit 13 that includes a transport belt or the like that transports the banknotes fed by the feeding unit 12, a banknote recognition unit 14 that recognizes the kind of the banknote transported by the banknote transport unit 13, and a banknote reversing unit that reverses the banknote transported by the banknote transport unit 13 based on face/back information included in the banknote kind obtained by the banknote recognition unit 14 so that the transported banknotes have the same face/back orientation, with face-up or face-down.

The banknote handling apparatus 2 further includes four stackers 16 for sorting and stacking the banknotes transported by the banknote transport unit 13 according to the banknote kind, and two first reject units 17A and 17B. The banknotes that are not stacked in any of the stackers 16 and also not bundled by the banknote bundling apparatus 3 are sent to the first reject units 17A and 17B. Stacking wheels 16E and 17C for stacking the transported banknotes, one at a time, at a predetermined position in a banknote stacking space, are provided in the stackers 16 and the first reject units 17.

The four stackers 16 include a first stacker 16A, a second stacker 16B, a third stacker 16C, and a fourth stacker 16D. The banknote kind to be stacked inside each of the stackers 16A to 16D is previously set. For example, if the US dollar banknotes are taken as an example, denomination information can be selected and allocated from among seven kinds, namely, USD 1, USD 2, USD 5, USD 10, USD 20, USD 50, and USD 100, as the banknote kind to each of the stackers 16A to 16D. Besides the denomination information, authenticity information for identifying genuine banknotes and counterfeit banknotes, fitness information for identifying fit banknotes and unfit banknotes, and face-back information for identifying the face-up banknotes and the face-down banknotes can be allocated as the banknote kinds. Furthermore, version information for identifying new printed version banknotes and old printed version banknotes can also be allocated. A currency kind can also be included in the banknote kind; for example, a banknote kind selected from banknotes of different countries, such as, USD 1 banknote, 1000 yen banknote, and 1 Euro banknote can be allocated. Furthermore, as the banknote kind, a stacking unit can be set as a spare. The stacking unit set as a spare is used for stacking the banknotes in place of the stacking unit to which the banknotes are allocated but which cannot accommodate the banknotes because it is completely filled or because of some malfunctioning.

The banknote sorting and bundling apparatus 1 includes a banknote transport path 18 that in turn includes a first transport path 18A that is connected to the hopper unit 11 and that passes above the stackers 16, a second transport path 18B that is connected to the first transport path 18A and that bends back in an arrangement direction of the stackers 16, and a third transport path 18C that is connected to the second transport path 18B, the stackers 16, and a bundling-side stacking unit 21. The banknote recognition unit 14 is arranged on the first transport path 18A. The banknote reversing unit 15 is arranged on the second transport path 18B. The second transport path 18B is configured as a device that can be detachably connected to the first transport path 18A and the third transport path 18C of the banknote sorting and bundling apparatus 1.

A tracking sensor 19 that detects whether a banknote that is being transported approaches or goes past each branching point, merging point, points of linkage between the apparatuses, etc., is arranged at each of the above-mentioned points on the banknote transport path 18. The tracking sensor 19 is also used when printing information on the bundling tape wrapped around the banknote bundle. Specifically, a position of the banknote bundle is detected by the tracking sensors 19 arranged on the transport path 18 and the banknote bundle is stopped at a predetermined standby position such that a printing position on the bundling tape of the banknote bundle is matched with a position where printing is performed by a printing unit.

A second reject unit 20 is arranged on the far end of the third transport path 18C. An elastic fin wheel 20A that stacks the transported banknotes, one at a time, at a predetermined position in a banknote stacking space is provided in the second reject unit 20.

A diverter 13A is arranged at each branching point on the banknote transport path 18 inside the banknote sorting and bundling apparatus 1. The diverter 13A diverts the banknote transported through the banknote transport path 18 to the stackers 16, the bundling-side stacking unit 21, the first reject units 17 or the second reject unit 20. When the tracking sensor 19 detects the banknote, the diverter 13A is driven by a not shown solenoid such that the banknote is transported to a transport destination.

The banknote reversing unit 15 has the function of selecting a transport path for the banknote between a reversing route and a non-reversing route, based on the face/back information included in the banknote kind information recognized by the banknote recognition unit 14. In the reversing route, the banknote is subjected to a reversing process by which the banknote is reversed to change the face/back orientation. In the non-reversing route, the banknote is transported without the reversing process. Consequently, all the banknotes are transported with uniform face-back orientation, that is, with a specific face is facing up, on the third transport path 18C that is downstream of the banknote reversing unit 15. For example, the reversing unit disclosed in Japanese Patent No. 4119664 can be used as the banknote reversing unit 15.

Figure 3:
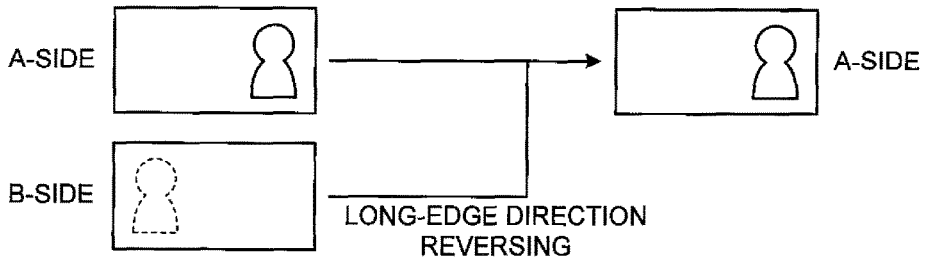
FIG. 3 is a drawing for explaining a reversing process performed by a banknote reversing unit.

FIG. 3 is a drawing for explaining the reversing process performed by the banknote reversing unit 15. As shown in FIG. 3, when an A-side (face-up) banknote is to be transported as it is in an A-side orientation (face-up orientation) on the third transport path 18C, the banknote is transported through the non-reversing route and not subjected to the reversing process by the banknote reversing unit 15. When a B-side (face-down) banknote is to be reversed so that the banknote is transported in the A-side orientation (face-up orientation) on the third transport path 18C, the banknote is transported through the reversing route and subjected to the reversing process by the banknote reversing unit 15. The side A, for example, as shown in FIG. 3, has a portrait printed thereon.

When an operation mode of the banknote sorting and bundling apparatus 1 is set to a mode in which banknotes are to be stacked with uniform face/back orientation, the uniforming face-back orientation process is performed by reversing the banknote, if required, based on the face/back information obtained by the banknote recognition unit 14. Consequently, all the banknotes are transported on the third transport path 18C with the side A or the side B facing upward, and stacked in the corresponding stacking units.

The banknote bundling apparatus 3 is explained below. The banknote bundling apparatus 3 includes the banknote transport unit 13 that transports the banknote of the specific denomination from the banknote transport path 18 in the banknote handling apparatus 2 into the banknote bundling apparatus 3, three bundling-side stacking units 21 that are arranged at three levels in an up-and-down direction inside the banknote bundling apparatus 3 and that sorts and stacks the banknotes of the specific denominations that are transported as bundling-object-banknotes, and a bundling unit 22 that is arranged below the three bundling-side stacking units 21 and that bundles the bundling-object-banknotes sorted and stacked in the bundling-side stacking unit 21 with a bundling tape when the number of the stacked bundling-object-banknotes reaches a predetermined number, for example, one hundred.

The banknote bundling apparatus 3 further includes a bundle dispensing outlet 23 that is located near the hopper unit 11 and that dispenses a banknote bundle bundled by the bundling unit 22 so that an operator can collect it, and a loose-banknote returning outlet 24 that is located near the bundling-side stacking unit 21 and that dispenses loose banknotes stacked in the bundling-side stacking unit 21 at the end of a transaction so that the operator can collect them.

An opening is formed in a back wall of the bundling-side stacking unit 21 to allow a hold unit 41 of a pre-bundling transport unit 25 to advance into a stacking space 31. A shutter that can be opened and closed is provided in the lower portion of the back wall to allow the hold unit 41 that has advanced through the opening to hold the bundling-object-banknotes stacked in the stacking space 31 from the long edge side thereof and pull out the stacked bundling-object-banknotes from the stacking space 31.

The banknote bundling apparatus 3 further includes the pre-bundling transport unit 25 that holds and transports the bundling-object-banknotes stacked in the bundling-side stacking unit 21 to the bundling unit 22 or the loose-banknote returning outlet 24, and a post-bundling transport unit 26 that holds and transports the bundling-object-banknotes in the bundling unit 22 in a direction parallel to the long edge of the banknotes and transports the banknote bundle bundled by the bundling unit 22 into the bundle dispensing outlet 23.

The pre-bundling transport unit 25 includes a transport unit 42 that has the hold unit 41 that holds the bundling-object-banknotes stacked in the bundling-side stacking unit 21 from the long edge side thereof, a horizontal movement mechanism 43 that moves the transport unit 42 forward and backward (in a horizontal direction), and a vertical movement mechanism 44 that moves the transport unit 42 upward and downward (in a vertical direction).

The vertical movement mechanism 44 includes a guiding shaft 44A that is vertically placed and that extends from a bottom end to a top end of the banknote bundling apparatus 3, and a driving belt 44B that raises and/or lowers the transport unit 42 along the guiding shaft 44A.

The transport unit 42 arranged in the pre-bundling transport unit 25 includes the hold unit 41 that is movable forward and backward by a driving belt 43A arranged in the horizontal movement mechanism 43. The hold unit 41, for example, includes an upper hand 41A with three holding pawls and a lower hand 41B with three holding pawls facing each other, and holds the bundling-object-banknotes stacked in the bundling-side stacking unit 21 from the long edge sides thereof with the holding pawls. The lower hand 41B is fixed whereas the upper hand 41A is movable up and down by a driving belt 41C.

The pre-bundling transport unit 25 holds one hundred bundling-object-banknotes stacked in the bundling-side stacking unit 21 from the long edge side thereof and transports them to a bundling stage 22A in the bundling unit 22. Moreover, at the end of the transaction, the pre-bundling transport unit 25 holds the loose banknotes, of which the number have not added up to one hundred, stacked in the bundling-side stacking unit 21, and transports them to the loose-banknote returning outlet 24. The bundling stage 22A corresponds to a bundling work area of the bundling unit 22.

The post-bundling transport unit 26 includes a hold and transport unit 27 and a dispensing transport unit 28. The hold and transport unit 27 adjusts a bundling position where the bundling tape is to be bound, by holding the bundling-object-banknotes, which are transported by the pre-bundling transport unit 25 to a work preparation position on the bundling stage 22A, from short edge side thereof and by moving the held bundling-object-banknotes in a direction parallel to the long edge of the banknotes. The pre-bundling transport unit 25 releases its hold on the bundling-object-banknotes from the long edge side thereof when the hold and transport unit 27 holds the bundling-object-banknotes from the short edge side thereof. After the bundling-object-banknotes are bundled by the bundling unit 22, the hold and transport unit 27 transports the banknote bundle to the dispensing transport unit 28. The dispensing transport unit 28 transports the banknote bundle received from the hold and transport unit 27 toward the bundle dispensing outlet 23.

The work preparation position on the bundling stage 22A is an initial position of the bundling-object-banknotes when transported onto the bundling stage 22A. An operation position is a position where the bundling-object-banknotes are bundled with the bundling tape after the bundling-object-banknotes are moved to adjust the position relative to the initial position.

The hold and transport unit 27 that holds the bundling-object-banknotes at the work preparation position moves the bundling-object-banknotes to adjust the position so that the bundling position of the bundling-object-banknotes is determined according to a bundling operation position. By aligning the bundling position of the bundling-object-banknotes with the bundling operation position on the bundling stage 22A, the bundling-object-banknotes can be bound with the bundling tape at the bundling position.

Upon completion of a bundling operation by the bundling unit 22 and returning of the banknote bundle to the work preparation position, the hold and transport unit 27 transports the banknote bundle toward the dispensing transport unit 28 via a banknote-bundle transport path. A stamp unit 71, which imprints a stamp mark upon the bundling tape on an upper surface side of the banknote bundle, is arranged above the banknote-bundle transport path. The stamp unit 71 includes a stamp 72 on an inside thereof, and has a function of imprinting the stamp mark upon the bundling tape by driving the stamp 72 up and down.

The hold and transport unit 27 transports the banknote bundle to the standby position below the stamp unit 71. The standby position is a position where the printing area, the stamp mark is to be imprinted, on the bundling tape matches with the lower position of the stamp 72. At the standby position, an imprinting surface of the stamp 72 is arranged parallel to the bundling tape on the upper surface of the banknote bundle.

The stamp unit 71 lowers the stamp 72 when the banknote bundle is at the standby position, and imprints the stamp mark on the bundling tape by causing the imprinting surface to contact with the bundling tape on the banknote bundle. In this manner, the information is printed on the predetermined area on the bundling tape.

Once an imprinting operation is completed, the stamp 72 is lifted up from the bundled-banknote transport path and held inside the stamp unit 71. The hold and transport unit 27 transports the banknote bundle bundled by the bundling tape, on which the stamp mark is imprinted, to the dispensing transport unit 28.

The hold and transport unit 27 releases its hold on the banknote bundle after transporting the banknote bundle into a banknote-bundle lifting unit 61 of the dispensing transport unit 28.

The dispensing transport unit 28 includes the banknote-bundle lifting unit 61 that transports the banknote bundle transported by the hold and transport unit 27 to an upper part of the banknote bundling apparatus 3, a pushing mechanism 62 that pushes the banknote bundle transported to the upper part of the banknote bundling apparatus 3 by the banknote-bundle lifting unit 61 towards the bundle dispensing outlet 23 (toward a front face of the apparatus), and a dispensing holding mechanism 63 that stacks the banknote bundle pushed to the front face of the apparatus by the pushing mechanism 62 and holds the banknote bundle in the bundle dispensing outlet 23 for dispensing.

The banknote-bundle lifting unit 61 transports the banknote bundle held and transported by the hold and transport unit 27 toward the pushing mechanism 62 located at the upper part of the banknote bundling apparatus 3.

The pushing mechanism 62 pushes and transports the banknote bundle transported to the upper part of the banknote bundling apparatus 3 by the banknote-bundle lifting unit 61 toward the bundle dispensing slot 23 (toward the front face of the apparatus) where the dispensing holding mechanism 63 is located.

The dispensing holding mechanism 63 includes a banknote-bundle stacking unit 63A that stacks the banknote bundle pushed and transported by the pushing mechanism 62 and a banknote bundle stage 63B onto which the banknote bundle stacked in the banknote-bundle stacking unit 63A is placed. The dispensing holding mechanism 63 adjusts the position of the banknote bundle stage 63B so that the banknote bundle pushed by the pushing mechanism 62 comes to rest on the topmost banknote bundle stacked on the banknote bundle stage 63B.

The bundling unit 22 binds the bundling-object-banknotes with the bundling tape when the bundling position of the bundling-object-banknotes held by the hold and transport unit 27 from the short edge side thereof is aligned with the bundling operation position on the bundling stage 22A.

The bundling unit 22 includes a bundling tape reel 501 that houses the bundling tape, a bundling tape stopper 502 that stops a leading edge of the bundling tape being drawn from the bundling tape reel 501 at the bundling position on the bundling-object-banknotes of which the bundling position is aligned with the bundling operation position, a swinging arm 503 that draws the other end of the bundling tape whose one end has been stopped on the bundling-object-banknotes, and wraps the bundling tape around the bundling-object-banknotes at the bundling position, a cutter 504 that cuts the other end of the bundling tape after the bundling-object-banknotes have been wrapped at the predetermined position, a heater 505 that subjects the other end of the bundling tape cut by the cutter 504 to heat welding, and a plurality of drive rollers 506 for drawing the bundling tape from the bundling tape reel 501.

Figure 4:
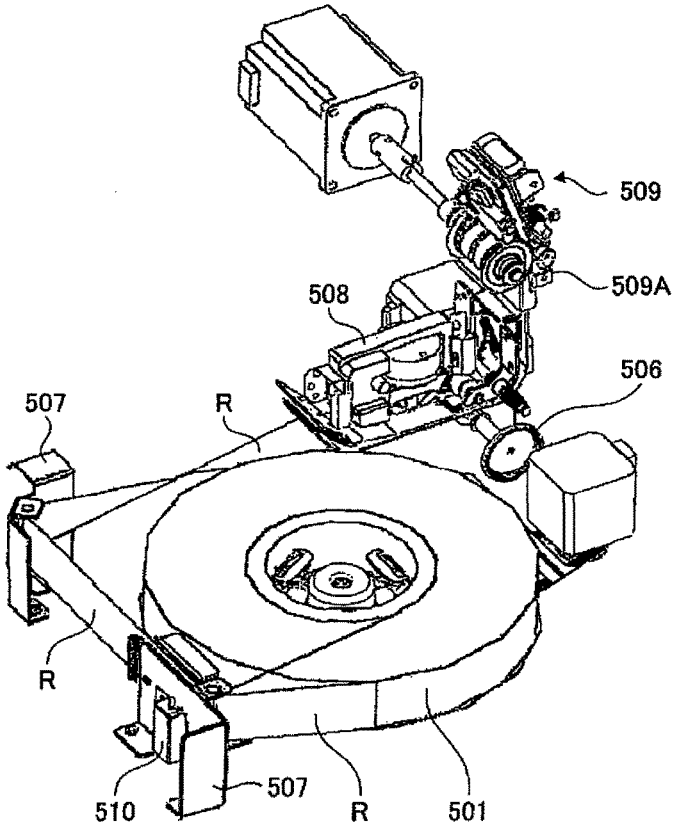
FIG. 4 is a perspective view of a portion of a bundling unit.
Figure 5:
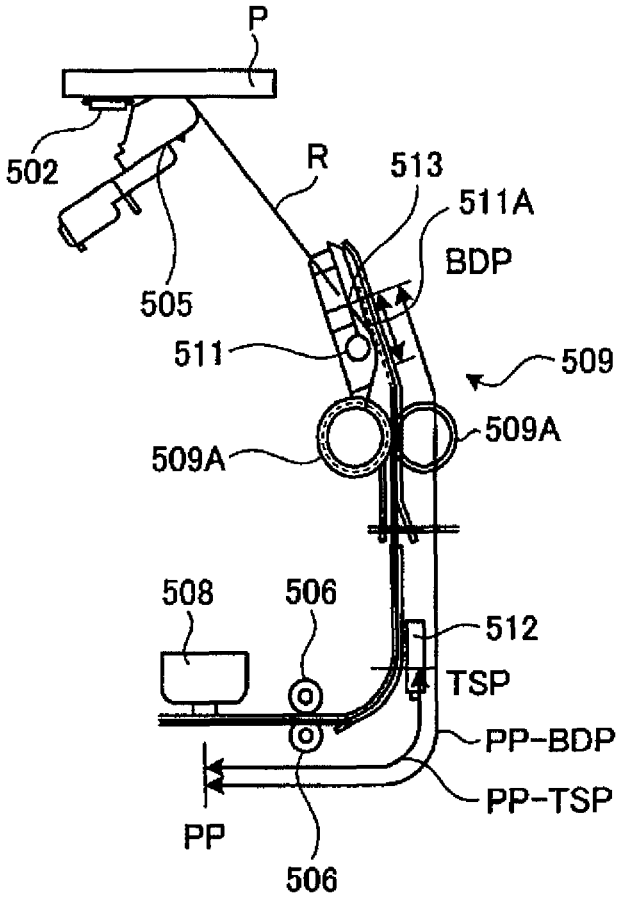
FIG. 5 is a cross-sectional view of a portion of the bundling unit.

FIG. 4 is a perspective view of a portion of the bundling unit 22. FIG. 5 is a cross-sectional view of a portion of the bundling unit 22.

The bundling unit 22 shown in FIGS. 4 and 5 includes, apart from the bundling tape reel 501 and the bundling tape stopper 502, the drive rollers 506 that draw out a bundling tape R from the bundling tape reel 501, bundling tape guides 507 that guide the bundling tape R drawn out by the drive rollers 506, a printer 508 that prints information on the bundling tape R drawn out by the drive rollers 506, a bundling-tape feeding unit 509 that includes feed rollers 509A that feed the bundling tape R to the bundling tape stopper 502, and an empty detecting unit 510 that detects whether the bundling tape R being drawn out from the bundling tape reel 501 is finished.

The drive rollers 506 and the bundling tape reel 501 are capable of performing normal rotation and reverse rotation. The bundling tape R is drawn out from the bundling tape reel 501 by the normal rotation of the drive rollers 506, and wound back on the bundling tape reel 501 by the reverse rotation of the bundling tape reel 501. During normal rotation of a driving motor, the drive rollers 506 are capable of pulling off an end portion of the bundling tape R adhering to a spool of the bundling tape reel 501.

The empty detecting unit 510 monitors a tail end of the bundling tape R, and upon detection of the tail end, decides that the bundling tape R has been drawn out from the bundling tape reel 501 and is finished.

The printer 508 prints various kinds of information on the bundling tape R. The printer 508 includes a dot impact print head, and can print characters and symbols on a predetermined position on the bundling tape R while the drive rollers 506 control the position of the bundling tape R relative to the printer head. The printer 508 can be of other types, such as, an inkjet printer, a thermal transfer printer, and a laser printer, as long as it is possible to print the information on the bundling tape R.

The bundling unit 22 shown in FIG. 5 includes a clench detecting unit 511 that is arranged at the leading end of the bundling-tape feeding unit 509 and that detects a clenching operation of the bundling tape R wrapped around bundling-object-banknotes P at the bundling position, a bundling-tape set passage detecting unit (hereinafter, simply "TS-passage detecting unit") 512 that judges whether the bundling tape R has gone past a bundling-tape set position TSP, and a bundling-tape delivery passage detecting unit (hereinafter, simply "BD-passage detecting unit") 513 that judges whether the bundling tape R has gone past a bundling-tape delivery position BDP where the bundling tape R is delivered to the bundling tape stopper 502.

The clench detecting unit 511 detects the clenching operation of the bundling tape R by a winding-back action of the drive rollers 506 and the feed rollers 509A, with the bundling-object-banknotes P in a state in which the bundling tape R is wrapped around them at the bundling position by the swinging arm 503.

The TS-passage detecting unit 512 detects whether the bundling tape R drawn out from the bundling tape reel 501 via the bundling tape guides 507, the printer 508, and the drive rollers 506, has gone past the bundling-tape set position TSP, which is an initial position.

The BD-passage detecting unit 513 detects whether the bundling tape R has gone past the bundling-tape delivery position BDP, which is a front-end position of the bundling-tape feeding unit 509.

A linear section 511A is formed from inside the clench detecting unit 511 up to the bundling-tape delivery position BDP. A distance between the empty detecting unit 510 and the bundling-tape set position TSP is set longer than a wrapping length of the bundling tape R.

Figure 6:
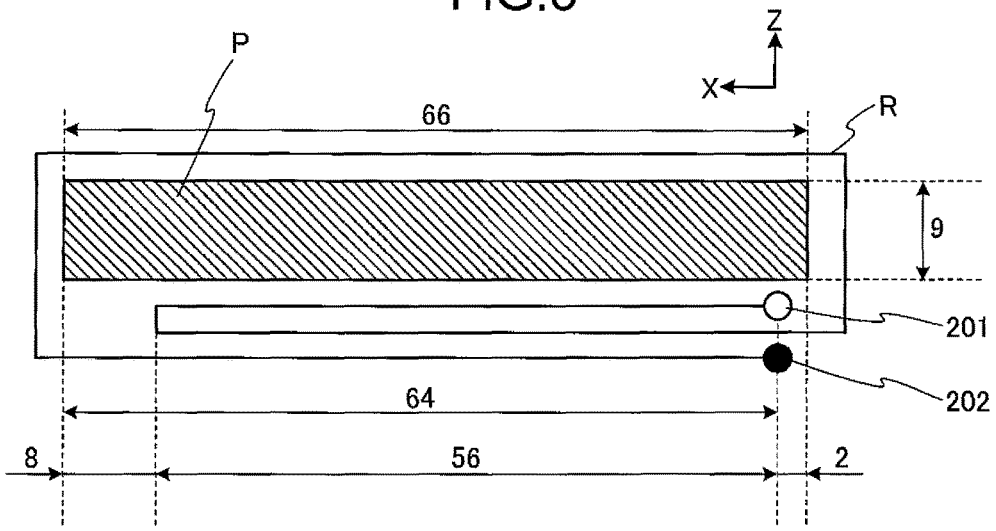
FIG. 6 is a drawing showing a wrapping length of a bundling tape used for bundling one hundred bundling-object-banknotes of a certain denomination.
Figure 7:
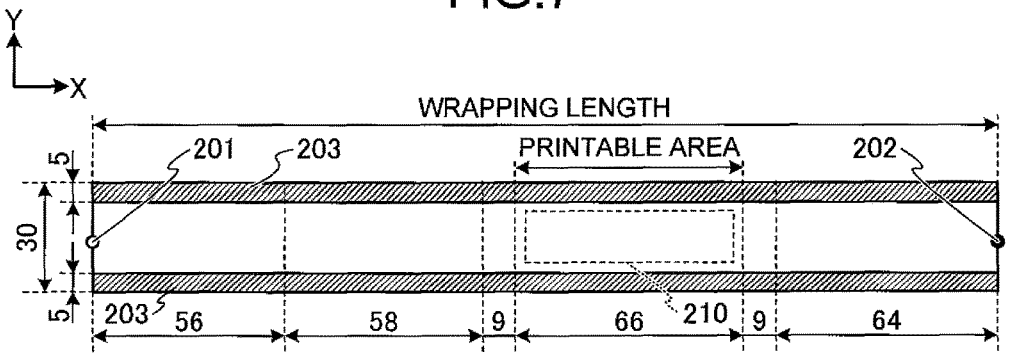
FIG. 7 is a drawing of a printing area on the bundling tape.

In the banknote bundling apparatus 3, the bundling-object-banknotes of various sizes can be bundled by matching the length of the bundling tape R with the size of the banknotes. Furthermore, by managing the position of the bundling tape R when forming the banknote bundle, information can be typed on the bundling tape R situated on one predetermined surface of the formed banknote bundle. FIG. 6 is a drawing showing the wrapping length of the bundling tape R used for making the banknote bundle of one hundred bundling-object-banknotes P of a certain banknote kind. FIG. 7 is a drawing of the printing area for printing the information on the bundling tape R.

In FIG. 6, a gap has been shown between the bundling-object-banknotes P and the bundling tape R for easy understanding of the state of the bundling tape R wrapped around the bundling-object-banknotes P; in actuality, an inner surface of the bundling tape R is in tight contact with an outer surface of the bundling-object-banknotes P. In FIG. 6, one end 201 of the bundling tape R is marked with a white circle and the other end 202 of the bundling tape R is marked with a black circle for easy understanding of a shape of the bundling tape R. In FIG. 7, the white circle and the black circle are shown to represent the two ends 201 and 202 of the bundling tape R for easy understanding of a correspondence relation with FIG. 6.

For example, one hundred bundling-object-banknotes P having a short edge measurement of 66 millimeter (mm) and a height of 9 mm are bound as shown in FIG. 6. In this case, the wrapping length of the bundling tape R from the end 201 to the end 202, as shown in FIG. 7, is 56 mm+58 mm+9 mm+66 mm+9 mm+64 mm, that is 262 mm in total.

In the banknote sorting and bundling apparatus 1, when the bundling tape R is wrapped around the bundling-object-banknotes P, the information is printed on the surface (+Z-axis side) opposite to the surface on which the ends 201 and 202 of the bundling tape R are present, as shown in FIG. 6. That is, because the information is printed on the upper surface side (+Z-axis side) of the bundling-object-banknotes, in FIG. 7, a width of 66 mm in an X-axis direction is available as a printable area for the information. However, taking into account the effect of dimension error that might occur while wrapping the bundling tape R, a printing area 210 is set 1 mm to 2 mm inside from each edge of the printable area.

Furthermore, as shown in FIG. 7, the bundling tape R bears on its both outer edges in a Y-axis direction a strip area 203 of a predetermined width and a predetermined color, pattern, etc.; the strip areas 203 are parallel to each other along the X-axis direction. The color and the pattern of the strip areas 203 correspond to the banknote kind of the bundling-object-banknotes P, facilitating easy recognition of the banknote kind of the banknote bundle based on the strip areas 203 of the bundling tape R.

Specifically, for example, the strip areas 203 having a width of about 5 mm can be purple in the bundle tape R for binding one hundred banknotes of USD 20, and yellow in the bundling tape R for binding one hundred banknotes of USD 10. Consequently, the banknote bundle can be easily recognized to be that of the banknotes of USD 20 if the color of the bundling tape R is purple, and that of the banknotes of USD 10 if the color of the bundling tape R is yellow.

The strip areas 203 can also bear a pattern. For example, the strip areas 203 can have a pattern of circles in case of fit notes that can be used again, and a pattern of crosses in case of unfit notes that cannot be used again. Thus, if the bundling tape R is yellow and has a pattern of circles, the banknote bundle can be recognized to be that of fit notes of USD 10. Characters or symbols that indicate the banknote kind can also be printed in the strip areas 203. The bundling tape R can have the color, the pattern, the characters, etc., pre-printed on the strip areas 203 or can be blank so that a printing process can be performed according to the banknote kind of the bundling-object-banknotes P. For example, if a color printer is used as the printer 508, the color or the characters can be printed in the strip areas 203 according to the banknote kind.

Figure 8:
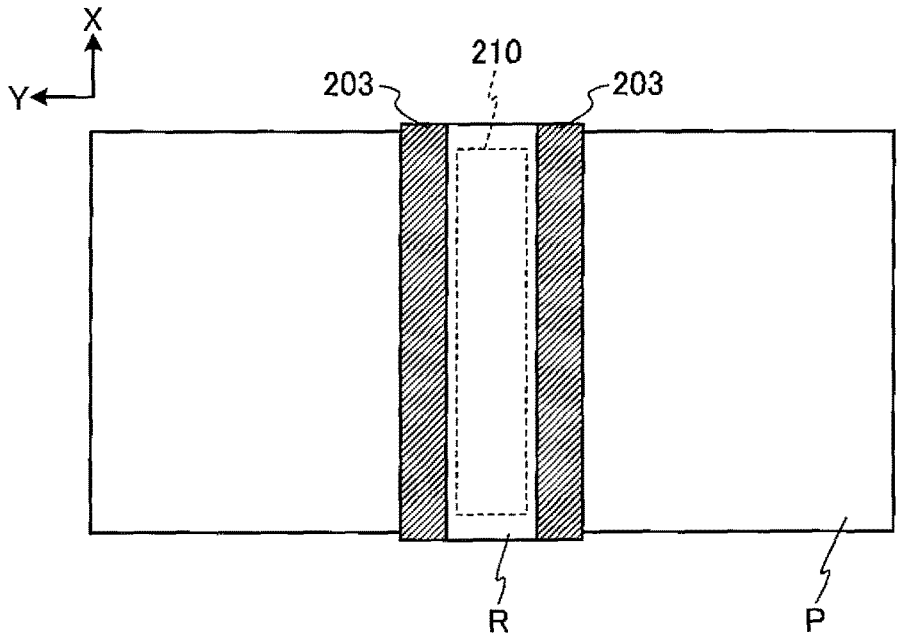
FIG. 8 is a drawing of the printing area on a banknote bundle.

In the banknote bundling apparatus 3, as shown in FIG. 7, a plain area formed by leaving 1 mm to 2 mm on inner side from the strip areas 203 is set as the printing area 210 to avoid difficulty in reading the printed information in the printing area 210 because of the printed information is inside of the strip areas 203. In the banknote bundling apparatus 3, as shown in FIG. 8, the printing area 210 is set on the upper surface of the banknote bundle P and the information is printed in the printing area 210.

Figure 9:
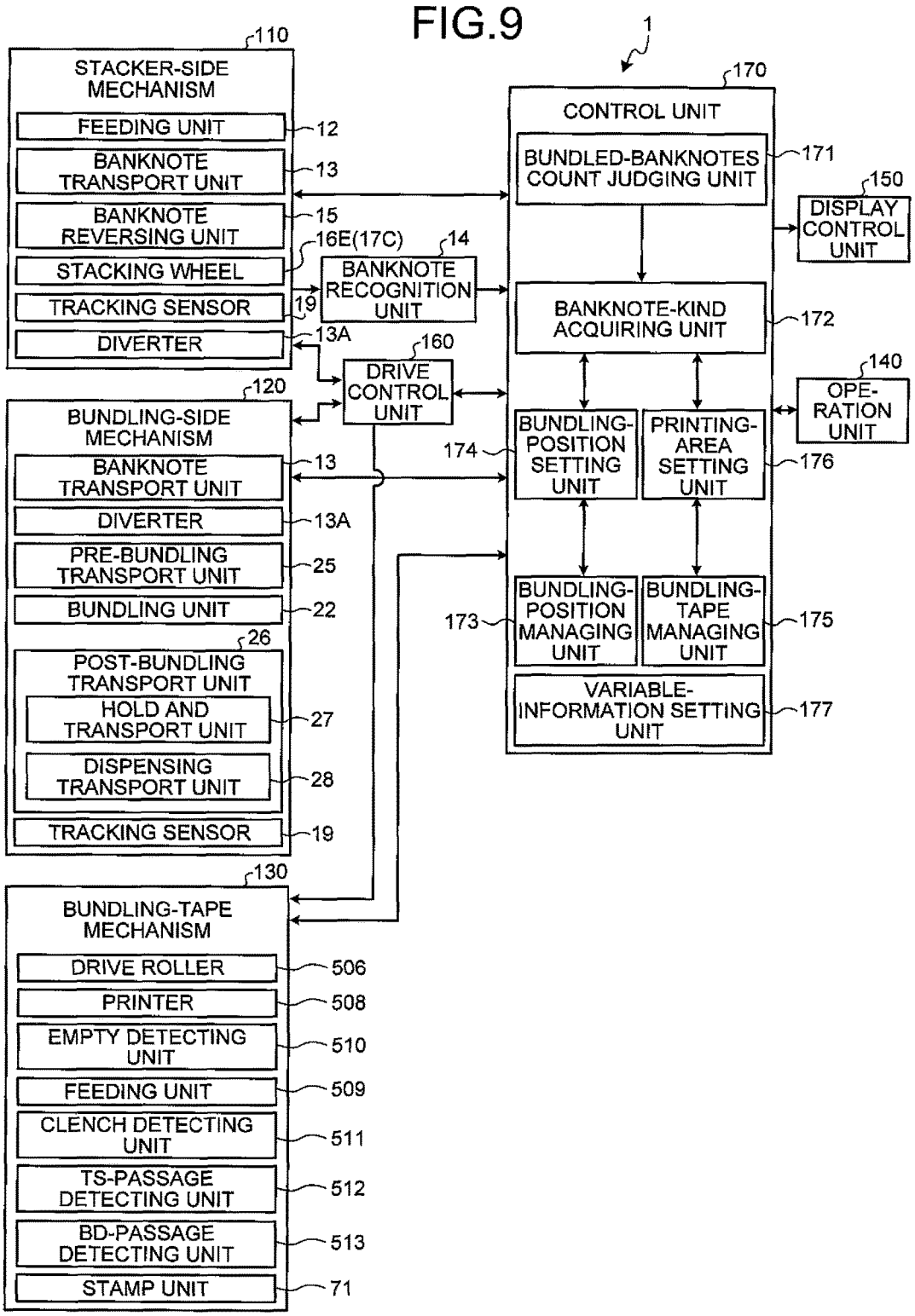
FIG. 9 is a block diagram of the banknote sorting and bundling apparatus.

FIG. 9 is a block diagram of the banknote sorting and bundling apparatus 1.

The banknote sorting and bundling apparatus 1 shown in FIG. 9 includes, apart from the banknote recognition unit 14, a stacker-side mechanism 110 arranged inside the banknote handling apparatus 2, a bundling-side mechanism 120 arranged inside the banknote bundling apparatus 3, a bundling-tape mechanism 130 of the bundling unit 22 arranged inside the banknote bundling apparatus 3, an operation unit 140 that is used for inputting various commands, a display control unit 150 that performs a display control of the display unit 4, a drive control unit 160 that performs a drive control of the stacker-side mechanism 110, the bundling-side mechanism 120, and the bundling-tape mechanism 130, and a control unit 170 that performs an overall control of the banknote sorting and bundling apparatus 1. Although not shown, the banknote sorting and bundling apparatus 1 also includes a memory for storing therein data necessary for the operation of each unit.

The stacker-side mechanism 110 includes the feeding unit 12, the banknote transport unit 13, the banknote reversing unit 15, the stacking wheel 16E (17C), as well as the tracking sensors 19 and the diverter 13A arranged inside the banknote handling apparatus 2.

The bundling-side mechanism 120 includes the tracking sensors 19, the banknote transport unit 13, the diverter 13A, the bundling unit 22, the pre-bundling transport unit 25, and the post-bundling transport unit 26 arranged inside the banknote bundling apparatus 3.

The bundling-tape mechanism 130 includes the drive rollers 506, the printer 508, the bundling-tape feeding unit 509, the empty detecting unit 510, the clench detecting unit 511, the TS-passage detecting unit 512, the BD-passage detecting unit 513, and the stamp unit 71.

The control unit 170 sets, for example, the banknote kinds to be stacked in the stackers 16, the first reject units 17, the second reject unit 20, and the bundling-side stacking unit 21. The control unit 170 allocates, for example, the banknote of USD 1 to the first stacker 16A, the banknote of USD 5 to the second stacker 16B, the banknote of USD 10 to the third stacker 16C, the banknote of USD 20 to the fourth stacker 16D, and the banknote of USD 2 to the first reject unit 17A. Furthermore, the control unit 170 allocates, as initial settings, the banknote of USD 10 to a first bundling-side stacking unit 21A, the banknote of USD 20 to a second bundling-side stacking unit 21B, and a third bundling-side stacking unit 21C as a spare. The first reject unit 17A is normally used as a stacking unit for rejected banknotes; however, it can also be used as a stacker for stacking uncommon kind of banknotes as indicated above.

The control unit 170 detects errors, such as, jamming of the banknotes on the transport path, based on a detection result of the tracking sensor 19.

The control unit 170 includes a bundling-object-banknote counting unit 171 that judges whether the number of the bundling-object-banknotes P, stacked in any of the three bundling-side stacking units 21, has reached one hundred, a banknote-kind acquiring unit 172 that acquires the banknote kind of the bundling-object-banknotes P of which the number has reached one hundred when the bundling-object-banknote counting unit 171 judges that the number of the bundling-object-banknotes P stacked in a particular bundling-side stacking unit 21 has reached one hundred, a bundling-position managing unit 173 that performs registration and management of the bundling position according to the banknote kind, and a bundling-position setting unit 174 that acquires from the bundling-position managing unit 173 the bundling position corresponding to the banknote kind acquired by the banknote-kind acquiring unit 172 and sets the bundling position.

When one hundred bundling-object-banknotes have been stacked in any of the first bundling-side stacking unit 21A, the second bundling-side stacking unit 21B, and the third bundling-side stacking unit 21C, the banknote-kind acquiring unit 172 acquires the banknote kind from at least one banknote from among the one hundred banknotes, based on the recognition result of the banknote recognition unit 14.

The bundling-position managing unit 173 manages the bundling position in the long edge direction of the banknote that is set for each banknote kind.

Upon acquisition of the banknote kind of at least one bundling-object-banknote P by the banknote-kind acquiring unit 172, the bundling-position setting unit 174 reads the bundling position corresponding to the banknote kind from the bundling-position managing unit 173. Thereafter, the bundling-position setting unit 174 sets the bundling position on the bundling-object-banknotes P, and inputs it in the drive control unit 160.

Consequently, based on the bundling position set by the bundling-position setting unit 174, the drive control unit 160 exerts control over the hold and transport unit 27 so that the bundling-object-banknotes P are placed on the bundling stage 22A of the bundling unit 22 with the bundling position of the bundling-object-banknotes P aligned with the bundling operation position.

The control unit 170 further includes a bundling-tape managing unit 175 that manages the wrapping length of the bundling tape R according to the banknote kind, and a position and dimensions of the printing area 210 included in the wrapping length, a printing-area setting unit 176 that acquires information pertaining to the wrapping length and the printing area 210 corresponding to the banknote kind acquired from the banknote-kind acquiring unit 172, and sets the acquired wrapping length and the printing area 210, and a variable-information setting unit 177 that sets variable information to be printed in the printing area 210 of the bundling tape R.

Upon acquisition of the banknote kind of the bundling-object-banknotes P by the banknote-kind acquiring unit 172, the printing-area setting unit 176 reads the information pertaining to the wrapping length and the printing area 210 of the bundling tape R corresponding to the banknote kind from the bundling-tape managing unit 175, and sets the wrapping length and the printing area 210 of the bundling tape R, and inputs them in the drive control unit 160.

Consequently, based on the wrapping length and the printing area 210 set by the printing-area setting unit 176, the drive control unit 160 exerts control over the printer 508 and the stamp 72 to imprint fixed information and the variable information upon the bundling tape R that is used for bundling by the bundling unit 22.

The variable-information setting unit 177 sets contents of the variable information to be printed on the bundling tape R when a user modifies the variable information. Consequently, the user can set desired information to be printed on the bundling tape R.

The control unit 170, at the initial settings of the bundling unit 22, prints the variable information in the printing area 210 of the bundling tape R by using the printer 508 while drawing out the bundling tape R from the bundling tape reel 501.

When the bundling-object-banknote counting unit 171 makes a decision that the number of the stacked bundling-object-banknotes P has reached one hundred, the control unit 170 prints the variable information in the printing area 210 of the bundling tape R by using the printer 508 before bundling the bundling-object-banknotes P by using the bundling unit 22. Thereafter, the banknote bundle is formed by wrapping the bundling-object-banknotes P at the bundling position with the wrapping length of the bundling tape R such that the printing area 210 lies on the upper surface of the banknote bundle. Thereafter, the bound banknote bundle is transported to imprint the fixed information on the printing area 210 of the bundling tape R by using the stamp. After cutting the bundling tape R for forming the current banknote bundle, the bundling tape R on the bundling tape reel 501 side is set at a predetermined position to prepare for the next bundling operation.

Furthermore, upon detection by the empty detecting unit 510 that the tail end of the bundling tape R has been pulled off the spool of the bundling tape reel 501 in the bundling unit 22 and the bundling tape R is finished, the control unit 170, without immediately stopping the bundling operation of the bundling tape R, performs one bundling operation in which the bundling tape R between the empty detecting unit 510 and the bundling-tape set position TSP is used as the bundling tape R for bundling before stopping the bundling operation. Consequently, the bundling tape R can be used right up to the end, contributing to economizing on the bundling tape R.

Upon acquiring the banknote kind recognized by the banknote recognition unit 14, if the banknote being transported through the banknote transport path 18 is of the banknote kind set for any of the stackers 16 or the bundling-side stacking unit 21, the drive control unit 160 exerts control over the banknote transport unit 13 and the diverter 13A so that the banknote is sorted and stacked in the stacker 16 or the bundling-side stacking unit 21 corresponding to the banknote kind.

If the banknote being transported through the banknote transport path 18 is not of the banknote kind set for any of the stackers 16 or the bundling-side stacking unit 21, or if the banknote cannot be recognized due to a transport error, etc., the drive control unit 160 exerts control over the banknote transport unit 13 and the diverter 13A so that the banknote is transported to the first reject unit 17. Because a banknote kind can be set to the first reject unit 17A, if the banknote being transported through the banknote transport path 18 is of the banknote kind set to the first reject unit 17A, the drive control unit 160 exerts control over the banknote transport unit 13 and the diverter 13A so that the banknote is sorted and stacked in the first reject unit 17A.

If the banknote being transported through the banknote transport path 18 is of the banknote kind that is set for the bundling-side stacking unit 21, the drive control unit 160 exerts control over the banknote transport unit 13 and the diverter 13A so that the banknote is sorted and stacked in the bundling-side stacking unit 21.

Assume that the banknote of USD 10 is set to the first bundling-side stacking unit 21A, the banknote of USD 20 is set to the second bundling-side stacking unit 21B, and the third bundling-side stacking unit 21C is set as spare, and one hundred bundling-object-banknotes have been stacked in the first bundling-side stacking unit 21A. In this situation, the drive control unit 160 exerts control over the pre-bundling transport unit 25 such that the bundling-object-banknotes stacked in the first bundling-side stacking unit 21A are removed by the hold unit 41 in the transport unit 42 of the pre-bundling transport unit 25.

When the number of banknotes of USD 10 stacked in the first bundling-side stacking unit 21A reaches one hundred, the control unit 170 sets the banknote kind of the spare third bundling-side stacking unit 21C as the banknote of USD 10, so that the third bundling-side stacking unit 21C is available for stacking the banknotes of USD 10. The control unit 170 thereafter sets the banknote kind of the first bundling-side stacking unit 21A, from which the stacked one hundred banknotes of USD 10 are removed by the hold unit 41 in the transport unit 42 and which is again available for stacking, as spare.

When the number of bundling-object-banknotes P stacked in the bundling-side stacking unit 21 reaches one hundred, the drive control unit 160 shown in FIG. 9 exerts control over the pre-bundling transport unit 25 so that the hold unit 41 of the transport unit 42 in the pre-bundling transport unit 25 advances into the stacking space 31 through an opening of a back wall, holds the bundling-object-banknotes P on a stage 32 from the long edge side thereof and pulls out the bundling-object-banknotes P from the bundling-side stacking unit 21, and that the horizontal movement mechanism 43 and the vertical movement mechanism 44 transport the bundling-object-banknotes P to the bundling unit 22.

At the end of the transaction, if the number of the bundling-object-banknotes P stacked in the bundling-side stacking unit 21 is short of one hundred, the drive control unit 160 exerts control over the pre-bundling transport unit 25 so that the hold unit 41 advances into the stacking space 31 through the opening 31C in the back wall 31B, holds the bundling-object-banknotes P on the stage 32 from the long edge side thereof, and pulls out the bundling-object-banknotes P from the bundling-side stacking unit 21, and that the horizontal movement mechanism 43 and the vertical movement mechanism 44 transport the bundling-object-banknotes P to the loose-banknote returning outlet 24.

After the bundling-object-banknotes P stacked in the bundling-side stacking unit 21 are drawn out, the drive control unit 160 causes the stage 32 inside the bundling-object stacking unit 21 to ascend and return to a normal standby position for waiting banknotes to be stacked therein.

If an error on a banknote is detected by the tracking sensor 19 when the banknote is upstream of the first reject unit 17B, the drive control unit 160 sequentially transports the banknotes that are upstream of the first reject unit 17B to the first reject unit 17B.

If an error on a banknote is detected by the tracking sensor 19 when the banknote is downstream of the first reject unit 17B, the drive control unit 160 exerts control over the banknote transport unit 13 and the diverter 13A so that the banknotes that are located downstream of the first reject unit 17B are sequentially transported to the second reject unit 20. When errors such as skewed state, chained state, or double-feed, etc., of the banknotes occur downstream of the first reject unit 17 B on the banknote transport path 18, that is, on the second transport path 18B or the third transport path 18C, the banknotes are allowed to be transported up to the second reject unit 20 without stopping the transport of the banknotes. Consequently, recovery for the errors can be made quickly.

The basic functions and operations of the pre-bundling transport unit 25 and the post-bundling transport unit 26 are disclosed in International Publication No. 2010/103619. Other than these transport units 25 and 26, the disclosure in International Publication No. 2010/103619 can be used for the conventional functions and operations of the constituent elements, which perform recognition, transport, sorting, stacking, and bundling of the banknotes, as well as discharge of the banknotes, the banknote bundles, etc., when detailed explanation is not disclosed in the present embodiment.

Figure 10A:
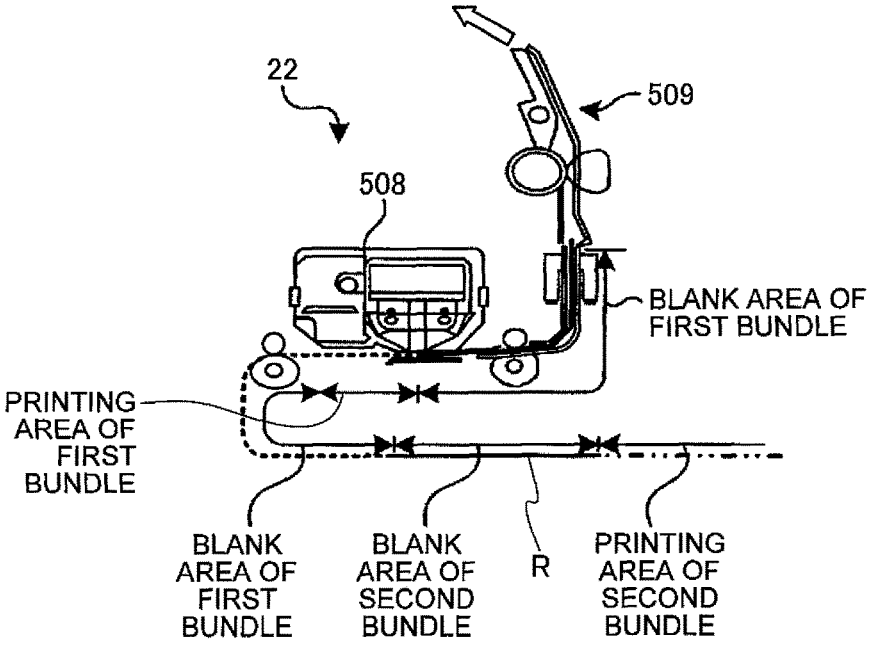
FIGS. 10A and 10B are a set of drawings showing a relation between positions of the bundling tape and the printing area during bundling of banknotes.
Figure 10B:
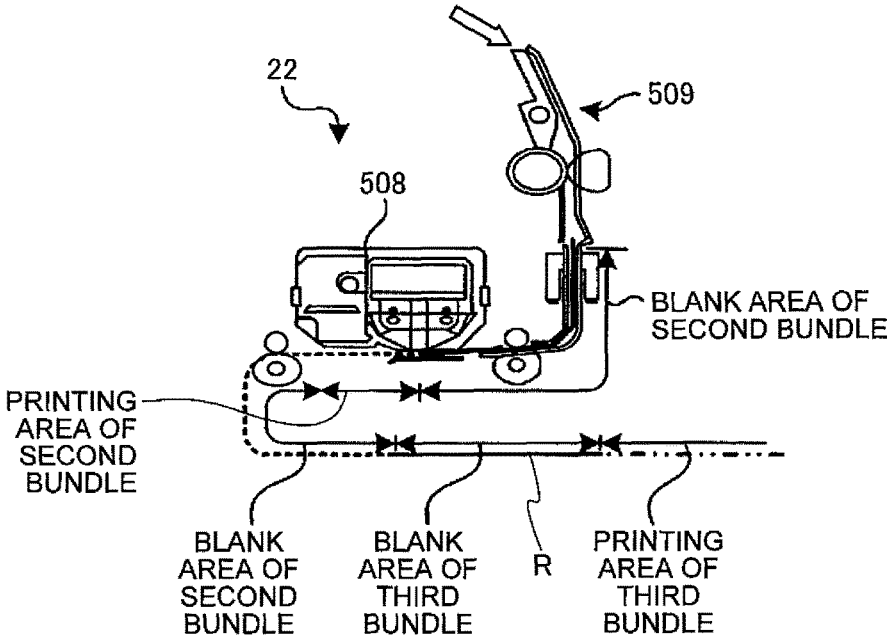

FIGS. 10A and 10B are a set of drawings showing a relation between positions of the bundling tape R and the printing area 210 during bundling of the bundling-object-banknotes.

When one hundred bundling-object-banknotes have been stacked in the bundling-side stacking unit 21, the bundling unit 22 draws out the bundling tape R from the bundling tape reel 501. When a length of the bundling tape R exceeds a blank area for a first bundle, the bundling unit 22 causes the printer 508 to print the variable information in the printing area 210 of the first bundle (see FIG. 10A). Thereafter, the bundling unit 22 bundles the one hundred bundling-object-banknotes with the bundling tape R on which the variable information is printed in the printing area 210.

After the end of the bundling tape R that is in a bundling process for bundling the bundling-object-banknotes of the first bundle is cut by the cutter 504, the bundling unit 22 winds back the bundling tape R on the bundling tape reel 501 side, and causes a print head of the printer 508 to stand by at a printing start position over the printing area 210 for printing the variable information on a second bundle (see FIG. 10B).

The bundling unit 22 repeats a similar operation for a third bundle and subsequent bundles. That is, when it is decided that the one hundred bundling-object-banknotes stacked in the bundling-side stacking unit 21 are to be bundled, the bundling-unit 22 repeats, the process for printing the variable information associated with the bundling-object-banknotes in the printing area 210 of the bundling tape R, the process of bundling the bundling-object-banknotes with the bundling tape R and the process of causing the print head of the printer 508 to stand by at the printing start position of the printing area 210 of the bundling tape R to be used in the next bundling process.

Figure 11:
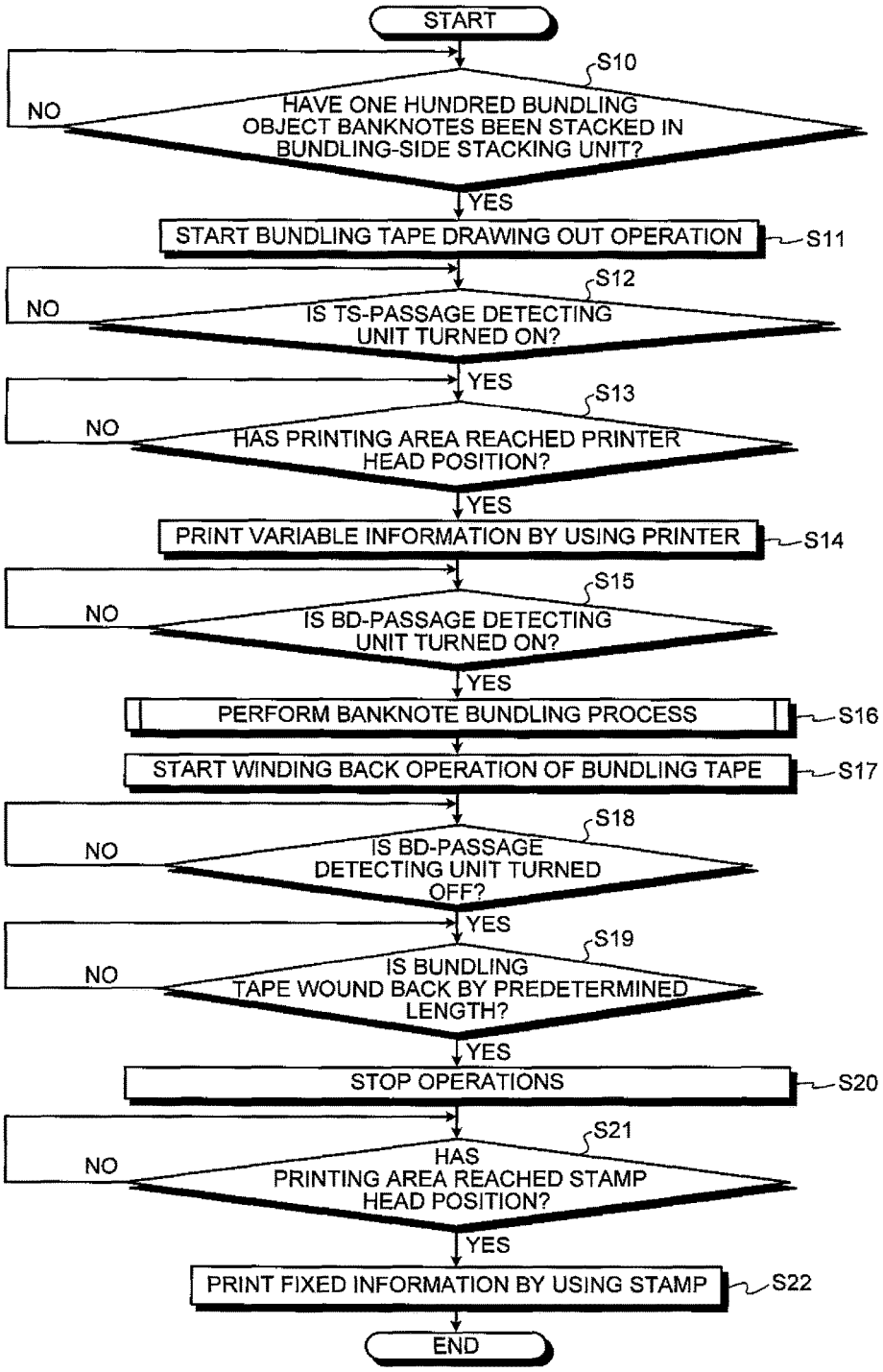
FIG. 11 is a flowchart for explaining operations relating to a bundling-tape printing process.

A printing process on the bundling tape R performed by the paper-sheet sorting and bundling apparatus 1 is explained below. FIG. 11 is a flowchart of a bundling-tape printing process.

The bundling-tape printing process shown in FIG. 11 includes a process of printing of the variable information on the bundling tape R and a process of printing of the fixed information. The process of printing of the variable information on the bundling tape R is performed by the printer 508 at a stage after it is decided that the bundling-object-banknotes P are to be bundled by the bundling unit 22 and before the actual bundling. The process of printing of the fixed information is performed by the stamp 72 on the bundling tape R wrapped around the banknote bundle that is transported by the post-bundling transport unit 26 after the bundling-object-banknotes P are bundled by the bundling unit 22.

The bundling-object-banknote counting unit 171 of the control unit 170 judges whether the number of the bundling-object-banknotes stacked in the bundling-side stacking unit 21 has reached one hundred (Step S10). If the number of the bundling-object-banknotes has reached one hundred (Yes at Step S10), the processes of printing the variable information and the fixed information are begun.

As shown in FIGS. 4 and 5, in the bundling unit 22, the leading end of the bundling tape R is drawn out from the bundling tape reel 501, and is brought up to the position where the drive rollers 506 are located, via the bundling tape guides 507 and the printer 508. The bundling tape R is set in a state of being able to be drawn out by the driving of the drive rollers 506.

As shown in FIG. 11, the control unit 170 begins the operation of drawing out the bundling tape R from the bundling tape reel 501 by the normal rotation of the drive rollers 506 and the feed rollers 509A (Step S11). The control unit 170 monitors the length of the bundling tape R from the time the leading end of the bundling tape R goes past a print head position PP of the printer 508, and adjusts the position of the printing area 210 of the bundling tape R relative to the print head of the printer 508 by the driving of the drive rollers 506, etc.

The control unit 170 judges whether, by the drawing operation of the bundling tape R, the TS-passage detecting unit 512 is turned on in response to the detection of the bundling tape R (Step S12).

If the TS-passage detecting unit 512 is turned on (Yes at Step S12), the control unit 170 judges that the bundling tape R has gone past the bundling-tape set position TSP, and judges whether the printing area 210 of the bundling tape R, which is continually being drawn out, has reached the print head position PP of the printer 508 (Step S13).

If the printing area 210 of the bundling tape R has reached the print head position PP of the printer 508 (Yes at Step S13), the control unit 170 causes the printer 508 to print the variable information (Step S14). The variable information is the information that is likely to vary every time the apparatus is used, such as, the bundled date and information about the operator of the apparatus.

The control unit 170 begins printing of the variable information and judges whether the BD-passage detecting unit 513 is turned on (Step S15). The printing operation of the variable information ends when all the variable information has been printed.

As explained with reference to FIGS. 10A and 10B, if the process is in a state after the bundling-object-banknotes have already been bundled, that is, if the process is in the state of bundling for the second or any subsequent time, the printing start position of the printing area 210 of the bundling tape R is set at the print head position PP of the printer 508. Therefore, in this case, without performing Steps S11 to S13, the printing process on the bundling tape R is begun (Step S14).

Thereafter, when the printing process performed by the printer 508 on the bundling tape R ends, the bundling tape R, which is continually being drawn out, is detected by the BD-passage detecting unit 513, and the BD-passage detecting unit 513 is turned on (Yes at Step S15 of FIG. 11). In response to the turning on of the BD-passage detecting unit 513, the control unit 170 judges that the printing process on the bundling tape R has ended.

Thereafter, the control unit 170 causes the bundling unit 22 to perform the bundling process (Step S16). Specifically, the bundling tape R is cut and subjected to heat welding after being further drawn out and wrapped around the bundling-object-banknotes. The banknote bundle is formed in this manner by binding the bundling-object-banknotes with the bundling tape R on which the variable information is printed. The bundling tape R is wrapped such that the printing area 210 lies on the upper surface side of the banknote bundle, as shown in FIG. 8.

While the bundling tape R that is cut when the banknote bundle is being formed is subjected to heat welding on the bundling-object-banknotes side, the winding back operation of the bundling tape R is begun on the bundling tape reel 501 side (Step S17). The bundling tape R is wound back by the reverse rotation operation of the bundling tape reel 501, the drive rollers 506, the feed rollers 509A, etc.

Once the bundling tape R is wound back, the control unit 170 judges whether the bundling tape R is in a state in which it is not detected by the BD-passage detecting unit 513, that is, whether the BD-passage detecting unit 513 has been turned off (Step S18).

If the BD-passage detecting unit 513 has been turned off (Yes at Step S18), the control unit 170 judges that the bundling tape R has been wound back short of the bundling-tape delivery position BDP, and judges whether the bundling tape R has been wound back by a predetermined distance from the bundling-tape delivery position BDP such that the leading end of the bundling tape R lies within the linear section 511A (Step S19).

Once the leading end of the bundling tape R is wound back by the predetermined distance from the bundling-tape delivery position BDP and a winding back process ends (Yes at Step S19), the operations of the drive rollers 506 and the feed rollers 509A are stopped (Step S20), and the bundling unit 22 stands by in a state, in which bundling can be started, until the next one hundred bundling-object-banknotes are transported to the bundling unit 22. The wound back bundling tape R is in a standby state for printing of the variable information relating to the next banknote bundle by the printer 508, as shown in FIG. 10B.

Once the banknote bundle is formed by binding of the bundling-object-banknotes by the bundling unit 22, the control unit 170 monitors the transport of the banknote bundle by the post-bundling transport unit 26 by using the tracking sensors 19. Thereafter, the control unit 170 judges whether the printing area 210 of the bundling tape R wrapped around the banknote bundle has reached the standby position for imprinting the stamp 72 (Step S21).

If the printing area 210 of the bundling tape R has reached the standby position for imprinting of the stamp 72 (Yes at Step S21), the control unit 170 causes the stamp 72 to imprint the fixed information in the printing area 210 of the bundling tape R (Step S22). The fixed information is the information that generally does not vary every time the apparatus is used, such as, a bank name and a branch name. Because the fixed information does not vary frequently like the information of operator using the apparatus, it can be imprinted by using the stamp 72.

In this manner, the bundling-tape printing process of printing the variable information by using the printer 508 and the fixed information by using the stamp 72 in the printing area 210 of the bundling tape R is completed.

In the bundling-tape printing process shown in FIG. 11, the printing process of the variable information on the bundling tape R is started after one hundred bundling-object-banknotes have been stacked. However, while the bundling-object-banknotes are being transported, by the pre-bundling transport unit 25, to the bundling unit 22 from the bundling-side stacking unit 21, in which one hundred bundling-object-banknotes have been stacked, the printing process of the variable information on the bundling tape R can be completed. Thus, a situation where other processes have to be suspended until the printing on the bundling tape R is completed can be avoided.

Figure 12:
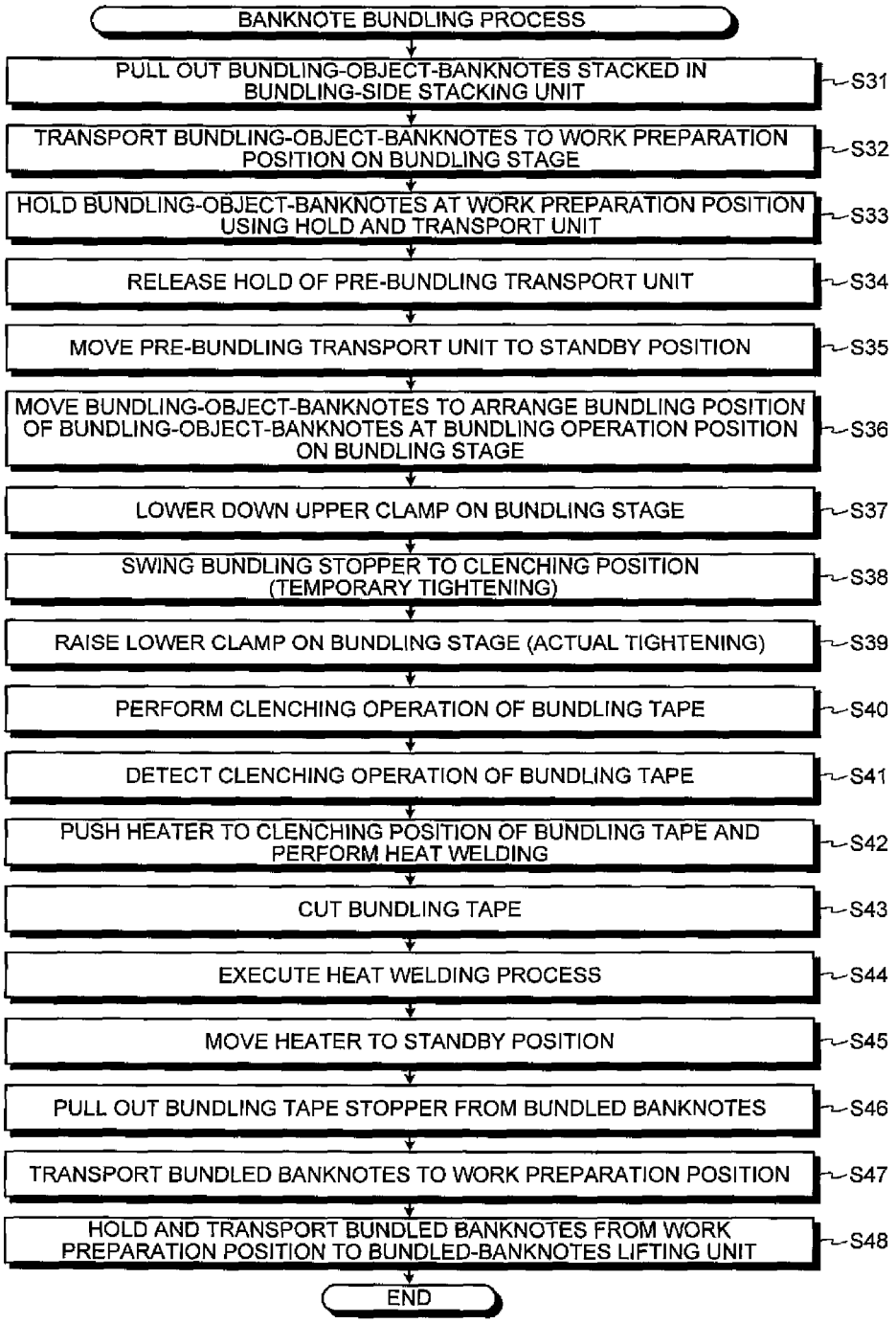
FIG. 12 is a flowchart for explaining operations relating to a banknote bundling process.
Figure 13:
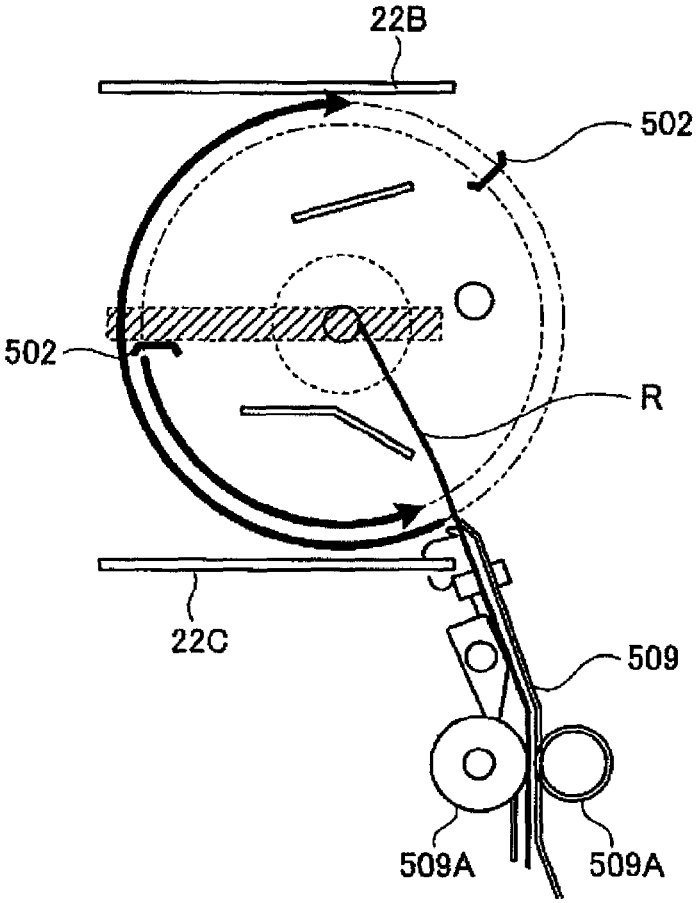
FIG. 13 is a drawing of an operation state of the bundling unit during bundling preparation.
Figure 14:
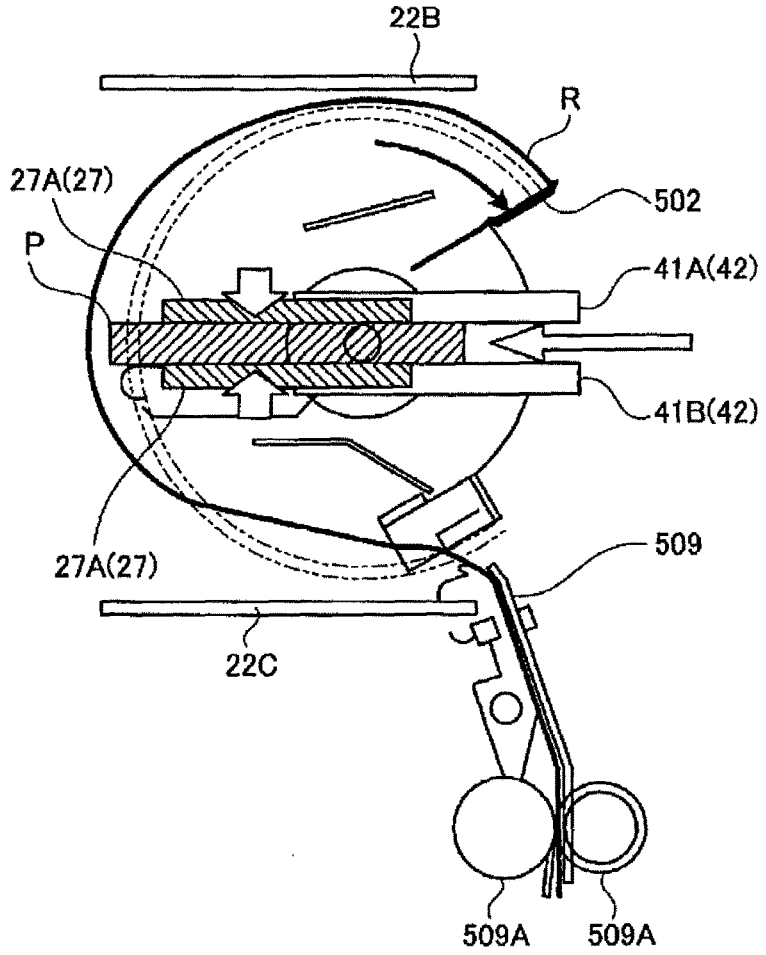
FIG. 14 is a drawing of an operation state of the bundling unit during setting of the bundling-object-banknotes.
Figure 15:
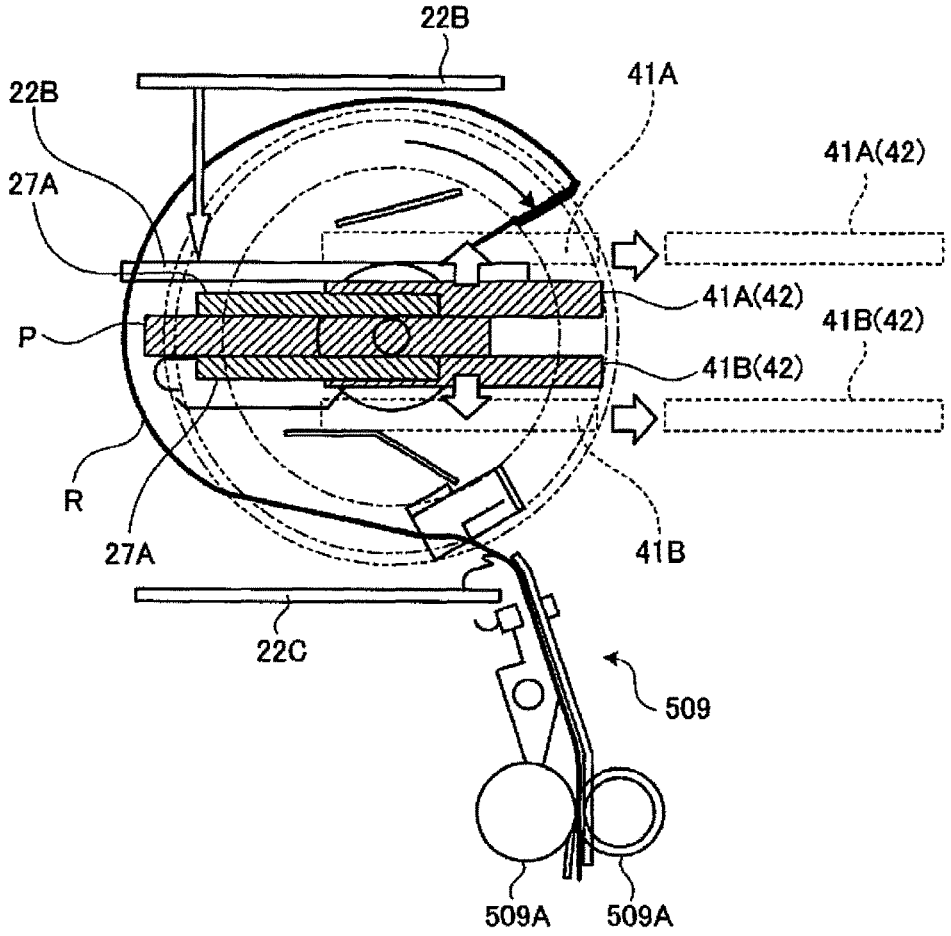
FIG. 15 is a drawing depicting an operation state of the bundling unit during detachment of a pre-bundling transport unit.
Figure 16:
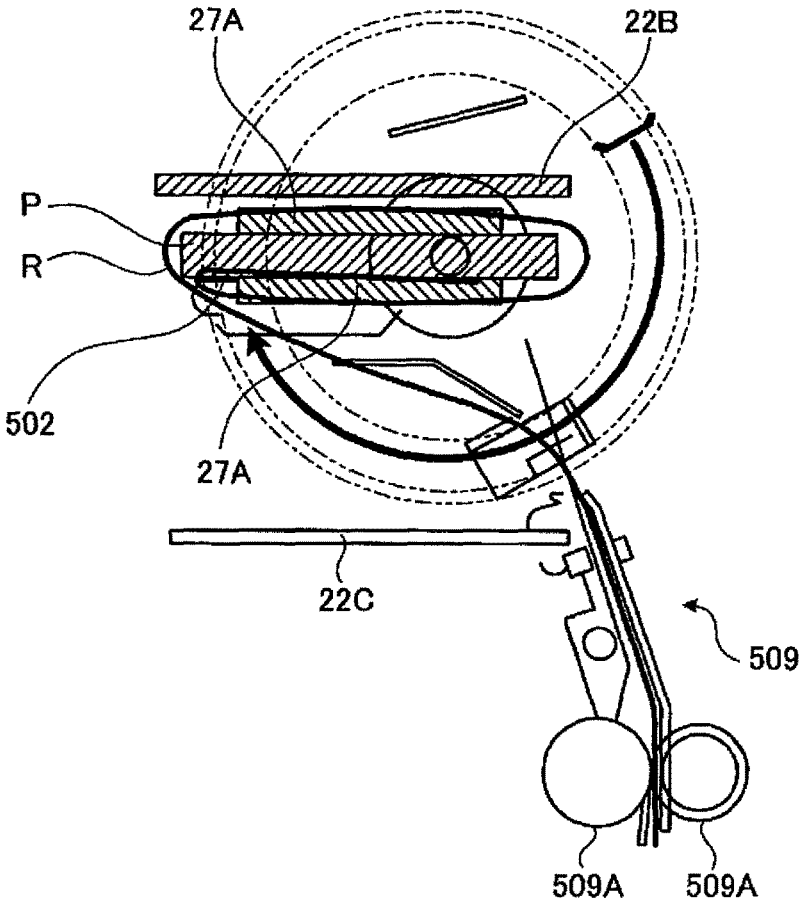
FIG. 16 is a drawing depicting an operation state of the bundling unit during temporary tightening.
Figure 17:
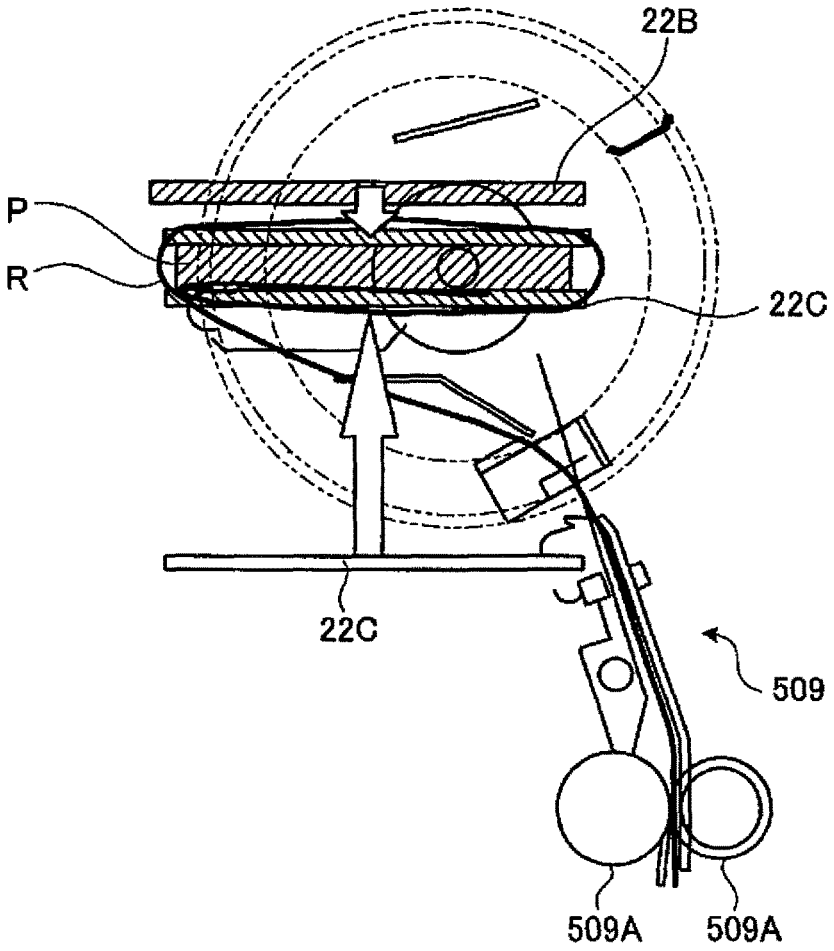
FIG. 17 is a drawing depicting an operation state of the bundling unit during actual tightening.
Figure 18:
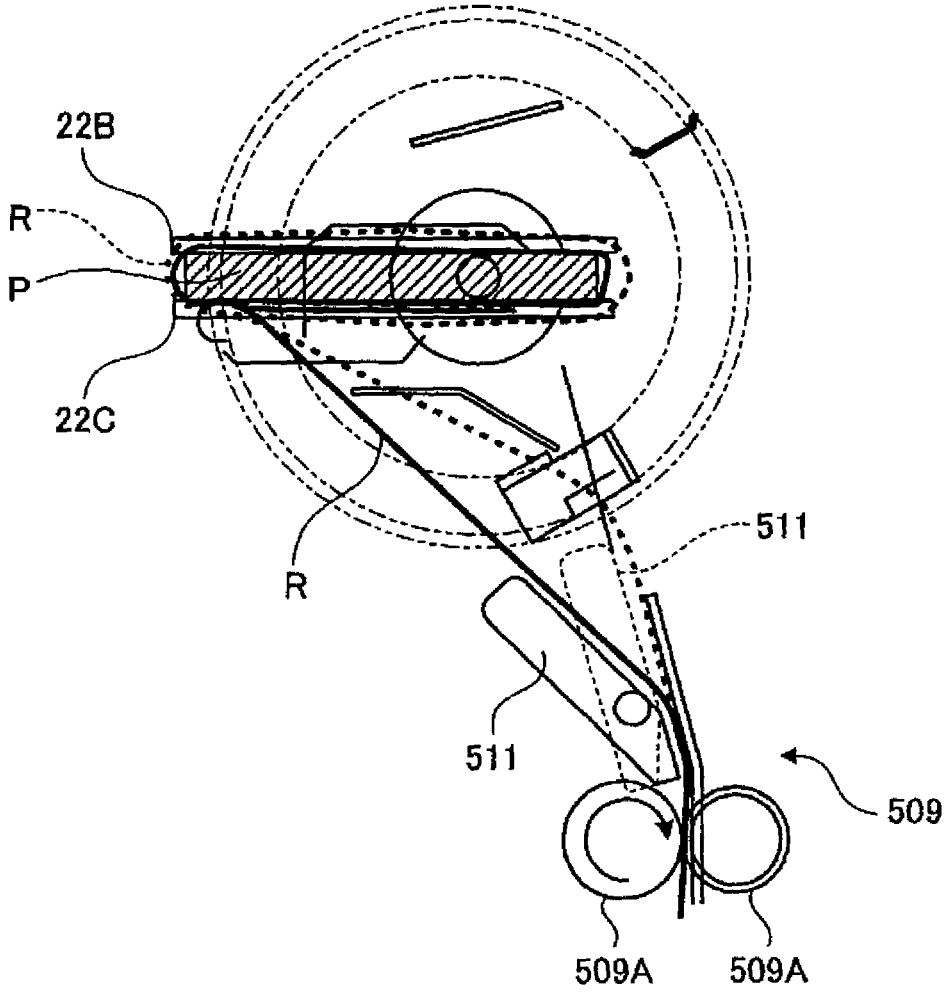
FIG. 18 is a drawing depicting an operation state of the bundling unit during clenching.

Operations of the bundling unit 22 are explained below with reference to FIGS. 12 to 18 as the banknote bundling operation (Step S16 shown in FIG. 11) in which one hundred bundling-object-banknotes are bundled with the bundling tape R. FIG. 12 is a flowchart of process operations performed by the control unit 170 relating to the banknote bundling process. FIG. 13 is a drawing depicting an operation state of the bundling unit 22 during bundling preparation. FIG. 14 is a drawing depicting an operation state of the bundling unit 22 during the setting of the bundling-object-banknotes. FIG. 15 is a drawing depicting an operation state of the bundling unit 22 during detachment of the pre-bundling transport unit 25. FIG. 16 is a drawing depicting an operation state of the bundling unit 22 during temporary tightening. FIG. 17 is a drawing depicting an operation state of the bundling unit 22 during actual tightening. FIG. 18 is a drawing depicting an operation state of the bundling unit 22 during clenching.

The banknote bundling process shown in FIG. 12 is a process by which, when one hundred bundling-object-banknotes have been stacked in one stacking unit, the banknote bundle is formed by bundling the one hundred bundling-object-banknotes with the bundling tape R.

As shown in FIG. 13, in the bundling unit 22, first the bundling tape stopper 502 is moved from a clenching position to the standby position by the swinging arm 503, and when an appropriate amount of the bundling tape R is fed by the bundling-tape feeding unit 509, the bundling tape stopper 502 is caused to move up to a higher position.

As shown in FIG. 12, when one hundred bundling-object-banknotes have been stacked in any of the three bundling-side stacking units 21, the control unit 170 exerts control such that the bundling-object-banknotes P are drawn out by the transport unit 42 of the pre-bundling transport unit 25 (Step S31) and transported to the work preparation position on the bundling stage 22A inside the bundling unit 22 (Step S32). As shown in FIG. 14, in the bundling unit 22, the bundling-object-banknotes P, which are held by the upper hand 41A and the lower hand 41B of the transport unit 42 from the long edge sides thereof, are transported to the work preparation position on the bundling stage 22A.

The control unit 170 further exerts control so that a hold member 27A of the hold and transport unit 27 holds the bundling-object-banknotes P from the short edge side at the work preparation position on the bundling stage 22A, as shown in FIG. 14 (Step S33).

The control unit 170 further exerts control so that when the short edge sides of the bundling-object-banknotes P are being held by the hold member 27A of the hold and transport unit 27, the transport unit 42 of the pre-bundling transport unit 25 releases the bundling-object-banknotes P from its hold (Step 534), and returns from the bundling unit 22 to the standby position (Step S35), as shown in FIG. 15.

Thereafter, the control unit 170 exerts control so that, as shown in FIG. 15, the bundling-object-banknotes P held by the hold member 27A of the hold and transport unit 27 is moved in a direction parallel to the long edges of the banknotes to adjust and set the bundling position of the bundling-object-banknotes P on the bundling operation position on the bundling stage 22A (Step S36). After performing the position adjustments, an upper clamp 22B is lowered to the banknote surface of the bundling-object-banknotes P on the bundling stage 22A (Step S37).

The control unit 170 then exerts control such that, with the upper clamp 22B lowered to the banknote surface of the bundling-object-banknotes P, the bundling tape stopper 502 is moved to the clenching position by the swinging arm 503 so that the temporary tightening state shown in FIG. 16 is attained (Step S38).

The control unit 170 thereafter raises a lower clamp 22C, causing the bundling-object-banknotes P on the bundling stage 22A to be in an actual tightening state between the lower clamp 22C and the upper clamp 22B (Step S39).

Furthermore, as shown in FIG. 18, the control unit 170 exerts control so that the bundling-object-banknotes P are clenched by rewinding the bundling tape R, which is wound at the bundling position of the bundling-object-banknotes P, by the reverse rotation operation of the bundling tape reel 501, the drive rollers 506, and the feed rollers 509A (Step S40).

When the clench detecting unit 511 detects the clenching of the bundling-object-banknotes P (Step S41), as shown in FIG. 18, the control unit 170 exerts control so that the heater 505 is pushed onto the other end of the bundling tape R at the clenching position to perform heat welding (Step S42), the cutter 504 cuts the other end of the bundling tape R (Step S43), and the heater 505 is pressed against the cut region of the bundling tape R to execute a heat welding process, thereby forming a banknote bundle P1 (Step S44). The clench detecting unit 511 detects the clenching operation of the bundling tape R, which is wound at the bundling position of the bundling-object-banknotes P by the swinging arm 503, based on the rewinding operation of the bundling tape R by the reverse rotation operation of the bundling tape reel 501, the drive rollers 506, and the feed rollers 509A.

When the heat welding process is completed, the control unit 170 moves the heater 505 to the standby position (Step S45), draws out the bundling tape stopper 502 from the banknote bundle P1 (Step S46), transports the banknote bundle held by the hold member 27A of the hold and transport unit 27 to the work preparation position (Step S47). The banknote bundle P1 is held and transported from the work preparation position to the banknote-bundle lifting unit 61 (Step S48), thereby completing the process operations shown in FIG. 12.

Thereafter, when the banknote bundle P1 is held and transported into the banknote-bundle lifting unit 61, the hold and transport unit 27 releases its hold on the short edge side of the banknote bundle P1. Thus, the dispensing transport unit 28 transports the banknote bundle P1 to the dispensing holding mechanism 63 via the banknote-bundle lifting unit 61 and the pushing mechanism 62.

Figure 19A:
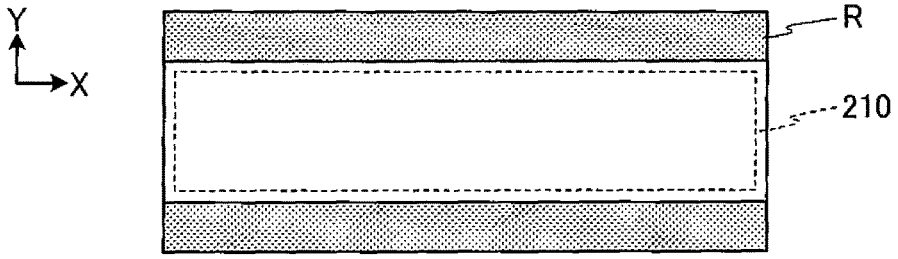
FIGS. 19A to 19D are a set of drawings showing examples of information printed on the bundling tape during the banknote bundling.

The variable information and the fixed information that are printed in the printing area 210 on the bundling tape R in the manner described above are explained next. FIGS. 19A to 19D are a set of drawings showing the upper surface of the bundling tape R that bundles the banknote bundle. As shown in FIG. 19A, the bundling process on the bundling-object-banknotes P is performed by the bundling unit 22 such that the printing area 210 lies on the upper surface side of the banknote bundle.

Figure 19B:
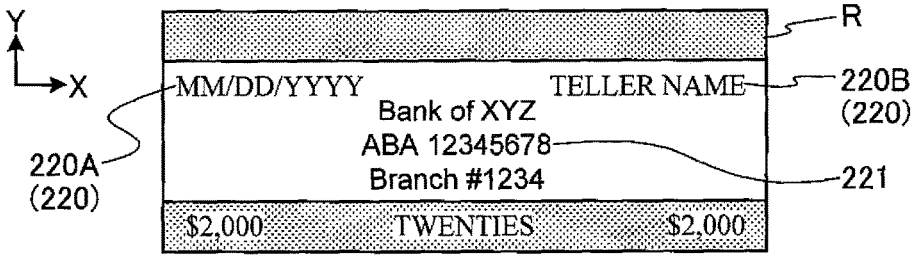

As shown in FIG. 19B, for example, the information relating to the date on which the bundling process is performed and the operator of the banknote bundling apparatus 3 in which the bundling process is performed is printed on the bundling tape R as variable information 220. As fixed information 221, for example, the bank where the bundling process is performed, an ABA No., and a branch No. are printed. If the user of the banknote handling apparatus 3 is required to print five pieces of information, which are bank name, the ABA No., the branch No., the bundled dated, and the operator's name, on the bundling tape R as shown in FIG. 19B, the user cannot change printing contents of the required information, but the user can add information to be printed on the bundling tape R.

In the banknote bundling apparatus 3, a printing position of the printer 508 and a printing position of the stamp unit 71 are automatically controlled so that the variable information 220 and the fixed information 221 are not printed in an overlapping manner in the printing area 210.

Specifically, the printing position of the variable information 220 that is printed by the printer 508 is controlled so that it is printed preferably on outer sides along the long edge direction (X-axis direction) and in the upper part of the printing area 210 (in the +Y-axis direction). Thus, as shown in FIG. 19B, in the printing area 210, a bundled date 220A is printed in the upper left corner and an operator name 220B of the operator who executed the bundling process is printed on the upper right corner.

On the other hand, the printing position of the fixed information 221 printed by the stamp unit 71 is controlled so that it is printed in the printing area 210 on the lower part (in the −Y-axis direction) preferably at the bottom in the short edge direction and at the center in the long edge direction (X-axis direction). Thus, the overlapping of the variable information 220 and the fixed information 221 can be avoided, making the printed information easy to read.

The printing positions of the variable information 220 and the fixed information 221 are not limited to those mentioned above but can be appropriately set based on the content of the information to be printed.

Specifically, the variable information 220 can include the information 220A, such as, the bundled date, in which even though the date can vary, the length of the printed matter is constant because a set format is followed (fixed printing length variable information) and the information 220B, such as, the operator name, in which not only the content but the length of the printed matter can also vary (indeterminate printing length variable information). In contrast, the fixed information 221 always has fixed dimensions because it is printed by the stamp 72.

In such a case, the printing positions of the fixed information 221 and the fixed printing length variable information 220A whose printing area dimensions are fixed can be set against one side of the printing area 210 without the two overlapping with each other or set as far apart as possible from each other on the two edges of the printing area 210. Thus, the area available for the indeterminate printing length variable information 220B in the printing area 210 is as wide as possible. The overlapping printing of the various pieces of information can be avoided by controlling the printing position of the indeterminate printing length variable information 220B so that it is printed as far apart as possible from the fixed printing length variable information 220A and the fixed information 221.

For example, as shown in FIG. 19B, by printing the bundled date 220A and the fixed information 221, which are the fixed printing length variable information, against the left edge within the printing area 210, a wide area can be secured on the right side in the printing area 210 as the printing area for the operator name 220B, which is the indeterminate printing length variable information. By setting the printing position of the operator name 220B as far apart as possible from the bundled date 220A and the fixed information 221, the overlapping printing of the various pieces of information can be avoided as much as possible.

Figure 19C:
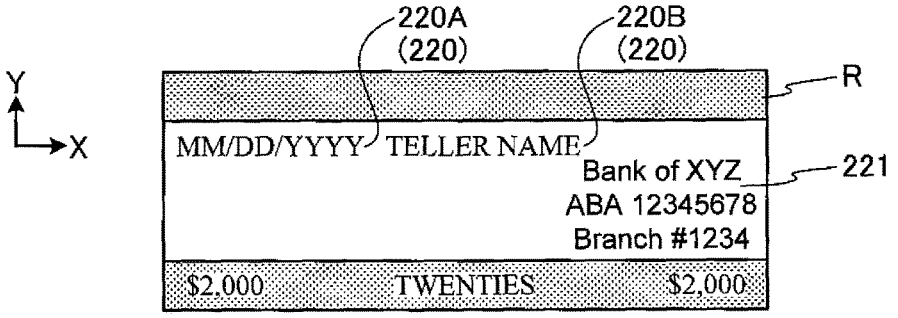

For example, as shown in FIG. 19C, by printing the bundled date 220A, which is the fixed printing length variable information, against the left side within the printing area 210 and the fixed information 221 against the side opposite to the bundled date 220A, that is, the right side, a wide area can be secured for the operator name 220B, which is the indeterminate printing length variable information, substantially center in the printing area 210. By setting the printing position of the operator name 220B, which is the indeterminate printing length variable information, as far apart as possible from the bundled date 220A and the fixed information 221, the overlapping printing of the various pieces of information can be avoided as much as possible.

Figure 19D:
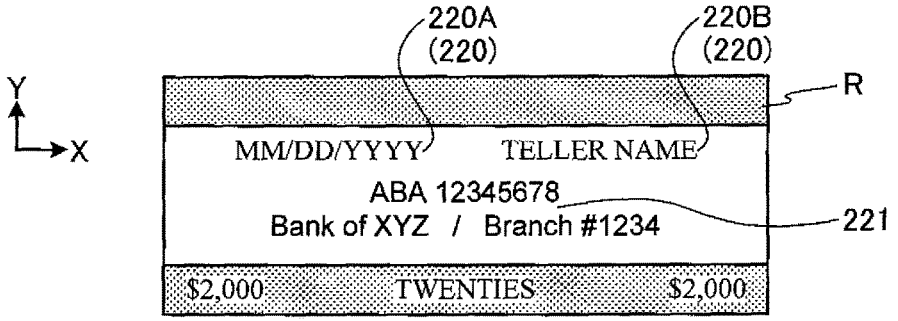

The printing method of the fixed information 221 is merely an example and is not limited to that described above. For example, as shown in FIG. 19D, the number of rows in the fixed information 221 that are imprinted by the stamp unit 71 can be reduced, thus making the fixed information 221 short in the Y-axis direction. In this case, for example, by printing the fixed information 221 and the variable information 220 far apart from each other in the Y-axis direction, and further printing the bundled date 220A and the operator name 220B far apart from each other, overlapping printing of the various pieces of information can be avoided as much as possible.

The relative printing positions of the variable information 220 and the fixed information 221 explained above can be fixed. Alternatively, the relative printing positions of the variable information 220 and the fixed information 221 need not be fixed and can be adjusted based on the indeterminate printing length variable information 220B of the variable information 220. Specifically, for example, in the example shown in FIG. 19B, instead of always printing the operator name 220B, which is the indeterminate printing length variable information, against the right edge of the printing area 210, the printing position of the operator name 220B can be adjusted according to a printing length of the operator name 220B so that it is positioned substantially centrally in the X-axis direction in the area between the right edge of the fixed information 221 and right edge of the printing area 210. In FIG. 19D also, the printing positions of the various pieces of information can be adjusted so that the bundled date 220A, the operator name 220B, and the fixed information 221 are all printed in a balanced manner according to the printing length of the operator name 220B.

In the examples shown in FIGS. 19B to 19D, the fixed information 221 of a plurality of rows is printed by the stamp unit 71 and the variable information 220 is printed in a single row. Because the variable information 220 can be printed in one row by the printer 508, an inexpensive printer 508 having a small print head can be used to print the various pieces of information in a short time. Furthermore, because the fixed information 221 that includes a lot of information, such as, the bank name, can be printed with the stamp in one imprinting operation, the time required for printing can be reduced compared to the case when all the information is printed by the printer 508.

The printing process by the printer 508 is performed after it is decided that the bundling-object-banknotes P are to be bundled. After completion of printing by the printer 508, the process of wrapping the bundling-object-banknotes P with the bundling tape R and bundling is performed. However, because of usage of the stamp unit 71, only the variable information 220 needs to be printed by the printer 508; thus, the printing can be completed by the printer 508 while the bundling-object-banknotes P are being transported from the bundling-side stacking unit 21 to the bundling unit 22. Consequently, the bundling of the bundling-object-banknotes P need not be suspended until the printing is completed by the printer 508, thus avoiding interrupting of other processes until the printing process is completed.

Figure 20:
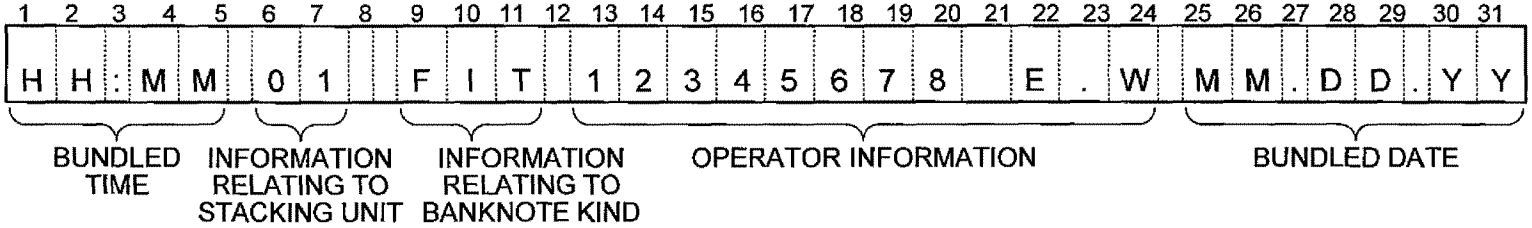
FIG. 20 is a drawing showing an example of information to be printed on the bundling tape.

An information amount printed as the variable information 220 varies according to the capability, such as, resolution, of the printer 508. However, as shown in FIG. 20, for example, 31 characters can be printed in a single row in the printing area 210 on the bundling tape R. As shown in FIG. 20, a bundled time, information relating to the stacking unit in which the bundling-object-banknotes being bundled are stacked, information relating to the banknote kind, information relating to the apparatus operator, the bundled date, etc., can be printed as the variable information.

The information relating to the stacking unit refers to an identification No., etc., that is unique to each stacking unit, and is the information by which the stacking unit, in which the bundling-object-banknotes P were stacked prior to being bundled as the banknote bundle, can be specified. The information relating to the banknote kind is the information, such as, fit note and unfit note included in the banknote kind. Any of a plurality of the pieces of information included in the banknote kind can be selected and set as the information relating to the banknote kind. The information relating to the apparatus operator is the information by which the operator, who executed the bundling of the banknotes, can be recognized. Other than the name of the operator, an identification No. or initials can be selected and set as the information relating to the apparatus operator.

The information relating to the date and time, and the stacking unit, the information relating to the banknote kind, etc. are automatically set by the control unit 170 based on the date and time managed inside the apparatuses, and results of recognizing, sorting and stacking of the banknotes performed in the banknote handling apparatus 2 and the banknote bundling apparatus 3. The information relating to the operator, etc., is automatically set by the control unit 170 based on the information previously set by the variable-information setting unit 177.

The contents of the variable information 220 shown in FIG. 20 are merely an example. The contents of the information printed on the bundling tape R, the order in which they are printed, the number of characters allocated to each piece of information, etc., can be modified by a print setting operation using the operation unit 140 and the display unit 4 according to the function the variable-information setting unit 177. Other than the contents of the information to be printed, settings relating to the printing positions can also be performed in the print settings. Specifically, the printing position of each piece of information can be automatically controlled, as in the above example, or the position where each piece of information is to be printed within the printing area 210 can be manually specified.

All or a part of the variable information 220 can be modified as required by the user of the apparatus. For example, if a government, etc., makes it mandatory that the bundled date be printed on the bundling tape R when making the banknote bundle, the setting of the bundled date included in the variable information 220 cannot be changed. Similarly, if the printing format or the printing position of the bundled date is stipulated by the government, etc., the contents of these settings can be made unalterable.

If the setting has to be performed on the bundling tape R for printing the name of the operator who executed the bundling process, it is necessary to change the operator name every time the operator who is using the banknote bundling apparatus 3 changes. To realize easy operation for the setting, in the banknote bundling apparatus 3, the operator information can be managed. Specifically, the banknote bundling apparatus 3 is designed so that it is possible to register the names of a plurality of operators who use the apparatus and easily select the name of the operator actually using the apparatus from among the registered operator names.

The selection and management of the operators that can be performed in the banknote bundling apparatus 3 are explained below. These operations are performed by operating the operation unit 140 while monitoring an operation screen displayed on the display unit 4. When the information relating to the operator setting is inputted via the operation unit 140, the variable-information setting unit 177 recognizes the information, and performs the setting process of adding or modifying the operator information.

Figure 21:
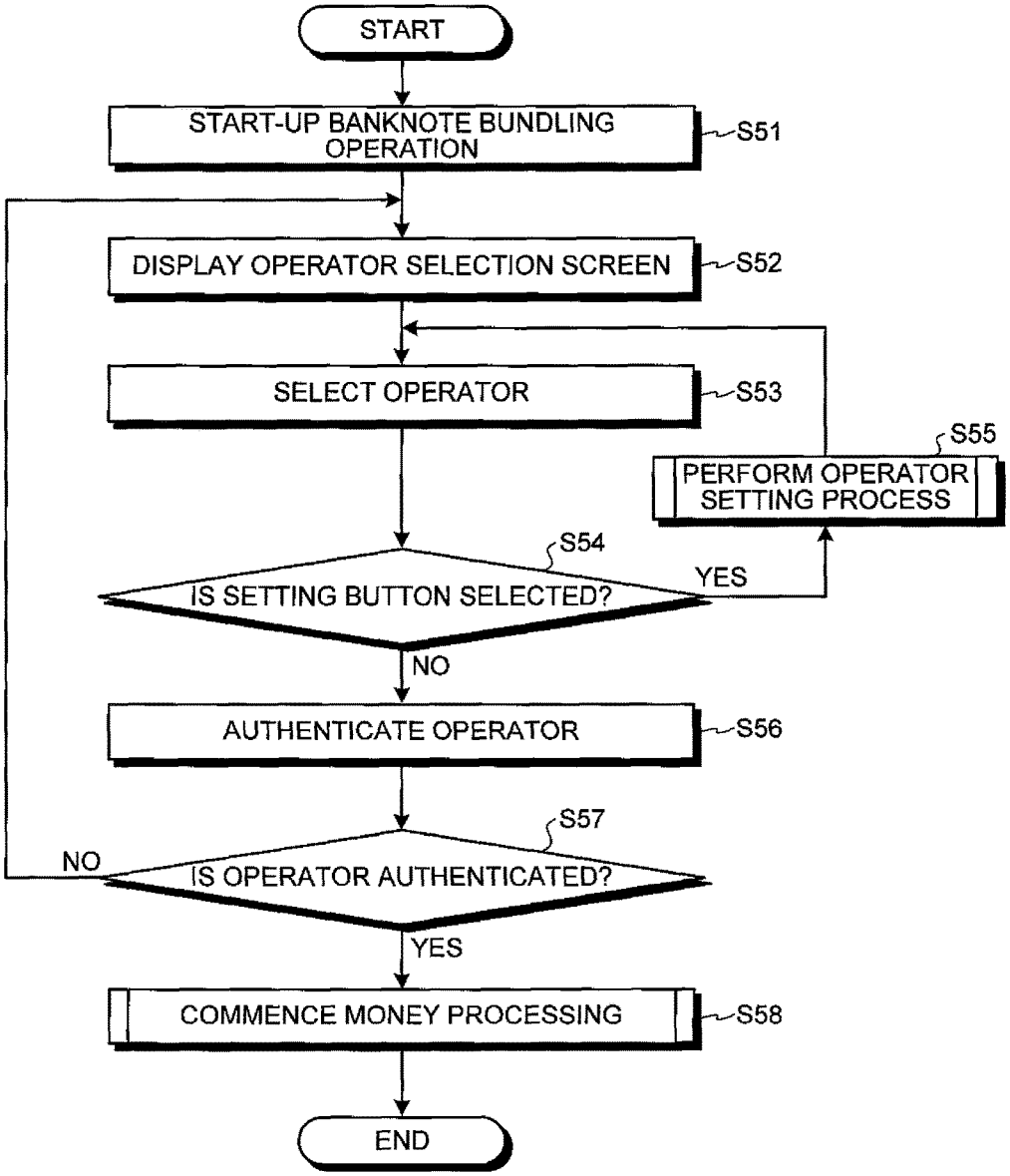
FIG. 21 is a flowchart for explaining operations of selection and setting of information to be printed on the bundling tape.
Figure 22:
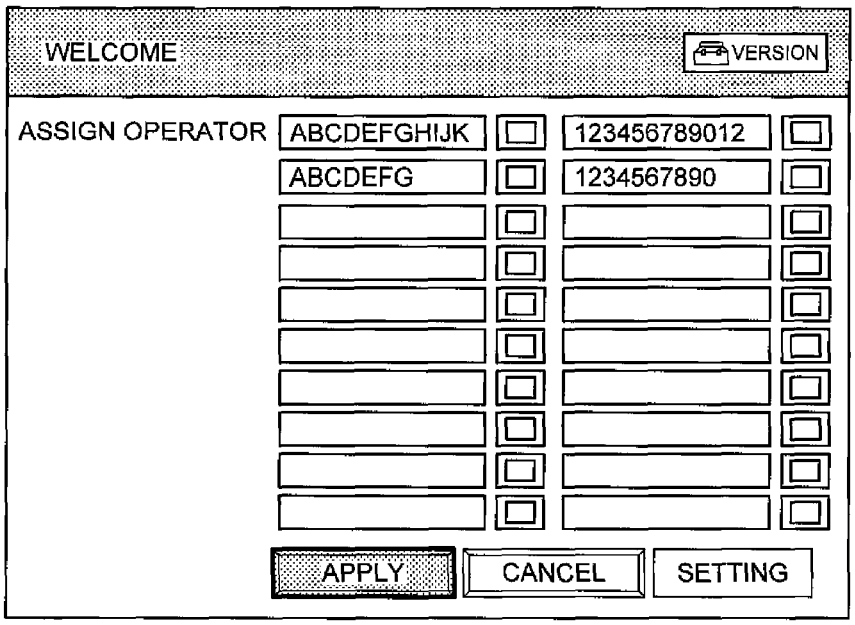
FIG. 22 is a drawing of a selection screen for selecting information to be printed on the bundling tape.
Figure 23:
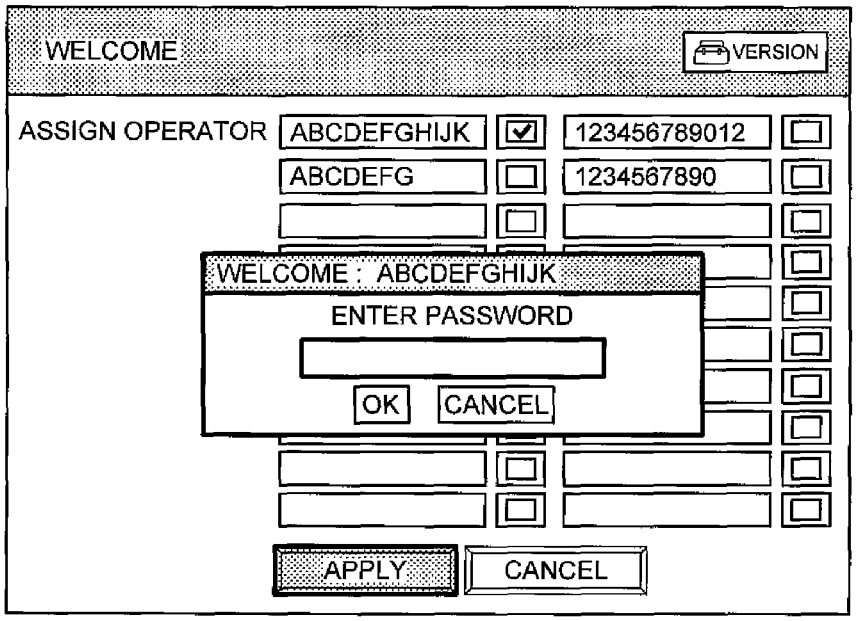
FIG. 23 is a drawing of an authentication screen for authenticating the information to be printed on the bundling tape selected and set during selection and setting.
Figure 24:
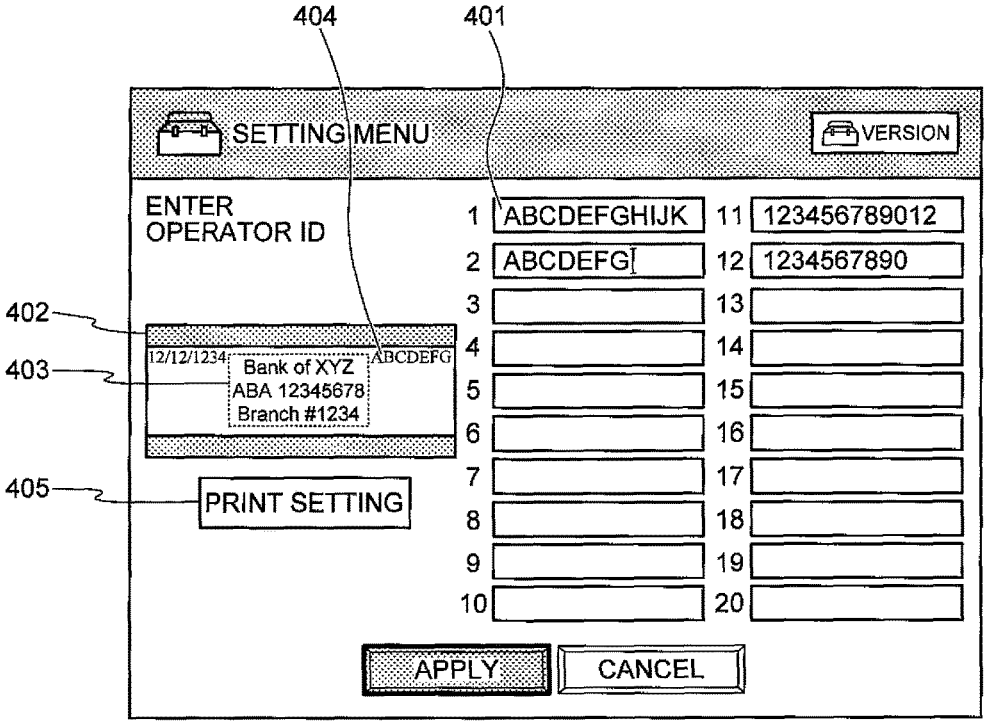
FIG. 24 is a drawing of a setting screen for the information to be printed on the bundling tape.

FIG. 21 is a flowchart of operations performed when using the banknote bundling apparatus 3. FIGS. 22 to 24 are drawings of the operation screens displayed on the display unit 4 by the display control unit 150 when performing these operations.

As shown in FIG. 21, to start the banknote bundling apparatus 3, a start-up process is performed by the operator of the apparatus (Step S51). Once the banknote bundling apparatus 3 is started up, an operator selection screen shown in FIG. 22 is displayed on the display unit 4 (Step S52).

The operator information that is already registered as the operators of the banknote bundling apparatus 3 is displayed on the operator selection screen. The operator who starts up the bundling apparatus 3 selects his/her own name or identification No., for example, by checking the relevant checkbox on the screen (Step S53).

If information about the operator is not available on the selection screen, a setting operation for adding and registering the operator information is performed. However, the operator information can be added only by any of the limited number of users already registered in the apparatus.

Specifically, when the user authorized to add the operator information selects himself/herself on the operator selection screen shown in FIG. 22, the Setting Button on the screen is enabled. Upon selection of the Setting Button (Yes at Step S54 of FIG. 21), an authentication screen prompting the user to enter the password, as shown in FIG. 23, is displayed on the display unit 4. The user inputs the password in the authentication screen and selects the OK Button. If the user is authenticated as the authorized user based on the password, a setting screen shown in FIG. 24 is displayed on the display unit 4. The user can perform the setting operation of adding and registering the new operator on the setting screen (Step S55 of FIG. 21).

As shown in FIG. 24, input fields 401 for registered operators and for adding and registering new operators are displayed on the setting screen for adding and registering the operator. In the setting screen shown in FIG. 24, 20 operators can be registered out of which two operators have been registered by their names and two operators by their identification Nos.

A print preview image 402 of the bundling tape R is displayed on the setting screen so that the operator can check how the bundling tape R will appear after the name of the operator is actually printed thereon. In the image 402, an area 403, which is adjacent to the printing position of the operator information and where the fixed information 221 is likely to be printed, is shown enclosed by a broken-line box. The area 403 is marked off taking into consideration a dimension error of a size of the stamp 72 used for printing the fixed information 221 and the position where the stamp 72 is imprinted. As the characters inputted in a particular input field 401 are modified, the characters of that input field 401 are displayed as a character string 404 in the image 402 on the setting screen. Thus, the user can input the operator information in the input field 401 while monitoring how it will appear when printed on the bundling tape R. Consequently, the contents inputted in the input field 401 can be adjusted so that the operator information inputted as the variable information 220 can be printed without overlapping with the fixed information 403.

Specifically, when the full name of the operator is inputted in the input field 401 and it causes the character string 404, which corresponds to the inputted content of the input field 401, to overlap with the print image 403 of the fixed information 221, on the setting screen, the information inputted in the input field 401 can be changed to the initials or the identification No. of the operator.

If the information inputted in the input field 401 is likely to overlap with the bundled date 220A or the fixed information 221, the fact can be displayed as an alert to inform the user. For example, if the variable-information setting unit 177 judges that the text string inputted in the input field 401 is long and is going to be printed overlapping with the fixed information 221, etc., the variable-information setting unit 177 notifies the fact by displaying alert information on the setting screen or by sounding an alarm.

The setting screen further includes a Print Setting Button 405 for modifying the print settings. Upon selection of the button 405, the contents to be printed as the variable information 220, the printing positions of the variable information 220, the printing position of the fixed information 221, etc., can be modified.

Once the setting operation (Step S55 of FIG. 21) is completed in the above-explained manner, and the Apply Button on the setting screen is selected, the contents that were set are stored in the variable-information setting unit 177.

Operable buttons and inoperable buttons appear in a distinguishable manner on the screens displayed on the display unit 4. So the content that is operable can be recognized on the screens. Specifically, on the operator selection screen shown in FIG. 22, the Apply Button for selecting and setting the operator appears enabled and the Setting Button that is used for adding and registering the operator information appears disabled. When an operator who has the authority to add the operator information is selected, the Setting Button also appears enabled similar to the Apply Button. From this screen display, it can be discerned that the selected operator can perform the operator setting operation. When performing predetermined operations, such as, adding and registering an operator and modifying the print settings for printing on the bundling tape R, the authentication screen shown in FIG. 23 is displayed. Thus, operations performed through impersonation can be prevented.

When the operator who started up the banknote bundling apparatus 3 selects himself/herself (Step S53 of FIG. 21) and selects the Apply Button on the operator selection screen (No at Step S54), the authentication screen prompting input of the password, as shown in FIG. 23, is displayed (Step S56).

When the operator inputs the password and selects the OK Button, if the password is authenticated (Yes at Step S56), a selection screen including processes and settings, which can be performed by the apparatus, is displayed on the display unit 4 to commence money processing (Step S58). Upon commencement of the money processing, the information relating to the operator authenticated by the earlier process is printed as a part of the variable information 220 on the bundling tape R of the banknote bundle being formed by the banknote bundling apparatus 3.

If the operator is not authenticated because of incorrect password, etc. (Step S57), the displayed screen returns to the operator selection screen (Step S52), and the operations have to be repeated from operator selection. The apparatus is designed to issue an alert when the operator authentication has failed a predetermined number of times. That is, no operation other than selection of the operator and the setting operation for adding an operator can be performed until the operator is authenticated.

Thus, when the apparatus is started up, the operator selection screen is displayed, enabling easy selection of the operator. An authentication process for determining whether the operator is the actual person selected on the selection screen is performed, and if the operator is found to be not authenticated, the operator is not allowed to perform money processing. Consequently, a situation where, the actual operator who performed the bundling process of the banknotes and the operator information printed on the bundling tape R are not matching, can be prevented. Furthermore, if an operator is not included in the selection screen, the operator can be easily added. When adding the operator, the status of the variable information 220 and the fixed information 221 that will be printed on the bundling tape R can be checked through the preview image. Consequently, a situation where, it is discovered that the setting needs to be checked after the matter is actually printed on the bundling tape R, and consequently, performing the setting once again, can be avoided.

Figure 25A:
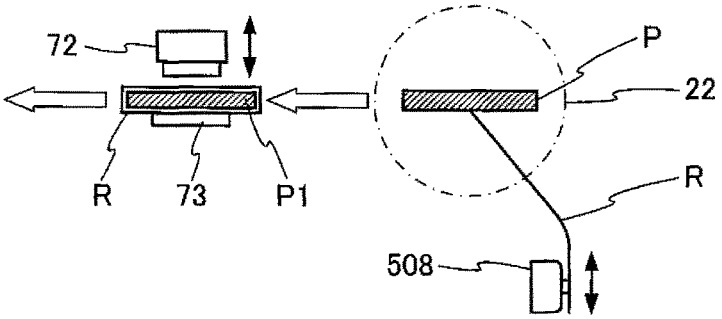
FIGS. 25A to 25D are a set of drawings showing examples of an arrangement of a printer and a stamp for printing on the bundling tape.

In the present embodiment, as shown in FIG. 25A, the variable information 220 is printed on the bundling tape R by the printer 508 before the bundling-object-banknotes P are bundled by the bundling unit 22, and the fixed information 221 is imprinted by the stamp unit 71 on the bundling tape R wrapped around the banknote bundle P1 after the bundling tape R is wrapped around the bundling-object-banknotes P and the banknote bundle P1 is formed by the bundling unit 22. Furthermore, as shown in FIG. 25A, the stamp unit 71 includes the stamp 72 and a printing stage 73 that supports the banknote bundle P1, with the stamp 72 and the printing stage 73 opposed to each other on either side of the banknote bundle P1. By this arrangement, the banknote bundle P1 is prevented from being shifted during the imprinting operation thereon, and the imprinting can be performed reliably.

However, the positional relation between the printer 508 and the stamp 72 is not limited to what is shown in FIG. 25A.

Figure 25B:
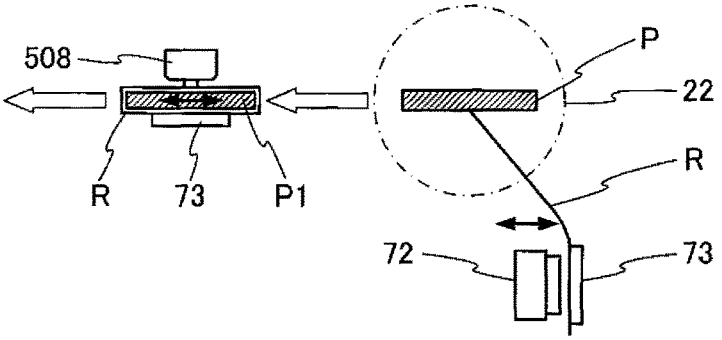

Specifically, as shown in FIG. 25B, the fixed information 221 can be printed on the bundling tape R by the stamp 72 before the bundling-object-banknotes P are bundled by the bundling unit 22, and the variable information 220 can be printed by the printer 508 on the bundling tape R wrapped around the banknote bundle P1 after the bundling tape R is wrapped around the bundling-object-banknotes P and the banknote bundle P1 is formed by the bundling unit 22. In this case, because the fixed information can be printed on the bundling tape R by the stamp 72 before one hundred bundling-object-banknotes P are stacked, the bundling process can be performed as soon as one hundred bundling-object-banknotes P are stacked. While, after bundling, the banknote bundle P1 is transported from the bundling unit 22 to the printer 508 for printing the variable information 220, the next lot of the bundling-object-banknotes P can be stacked and the bundling process can be performed in the bundling unit 22.

Figure 25C:
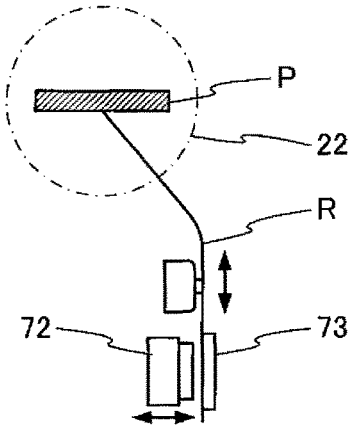

Furthermore, as shown in FIG. 25C, the fixed information 221 can be imprinted by the stamp 72 and the variable information 220 can be printed by the printer 508 before the bundling-object-banknotes P are bundled by the bundling unit 22.

Figure 25D:
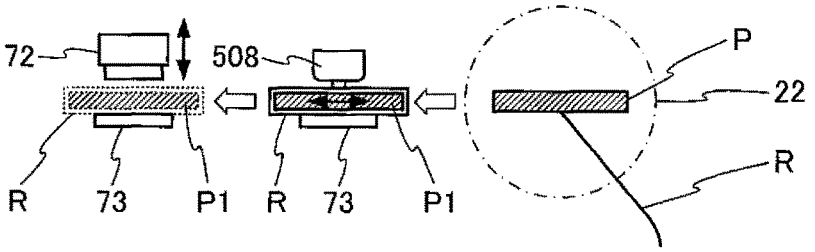

Alternatively, as shown in FIG. 25D, the fixed information 221 can be imprinted by the stamp 72 and the variable information 220 can be printed by the printer 508 on the banknote bundle P1 after the bundling-object-banknotes P are bundled by the bundling unit 22. In this case too, similar to the case shown in FIG. 25B, the bundling process of the bundling-object-banknotes P can be performed without having to wait for the completion of the printing process on the bundling tape R, and the stacking process and the bundling process of the next bundling-object-banknotes P can be commenced after the banknote bundle P1 is moved.

In the cases where printing is performed after the formation of the banknote bundle P1, the printing is performed after the banknote bundle P1 is transported from the bundling unit 22 as explained with reference to FIGS. 25A, 25B and 25D. However, the printing can be performed on the bundling stage of the bundling unit 22 without having to transport the banknote bundle P1 from the bundling unit 22.

An arrangement relation between the printer 508 and the stamp 72 can be appropriately decided according to the size of the apparatus and constraints imposed by the layout of the constituent elements inside the apparatus, etc. For example, in cases, such as, where the stacking unit in which the bundling-object-banknotes P are stacked serves as the bundling unit 22 and where the bundling unit 22 is arranged near the stacking unit in which the bundling-object-banknotes P are stacked, it is preferable that the printer 508 and the stamp 72 have the arrangement relation shown in FIG. 25B or FIG. 25D, so that the bundling process and the stacking process of the banknotes do not have to be paused until the printing process is completed.

Figure 26:
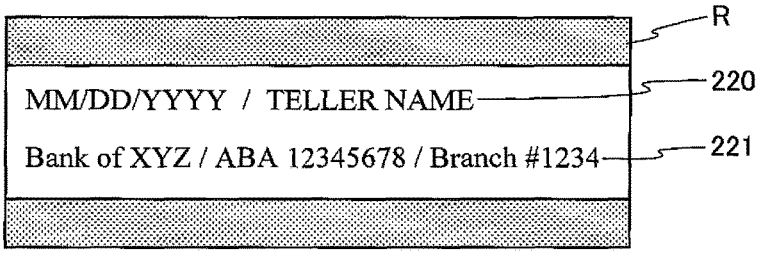
FIG. 26 is a drawing showing an example in which two rows of a character string are printed on the bundling tape.

In the present embodiment, a single row of the variable information 220 is printed by the printer 508 and the fixed information is imprinted by the stamp 72. However, the printing mode need not be limited to the above. For example, the information can be printed in two of more rows by the printer 508. In this case, for example, as shown in FIG. 26, both the variable information 220 and the fixed information 221 can be printed by the printer 508.

Figure 27A:
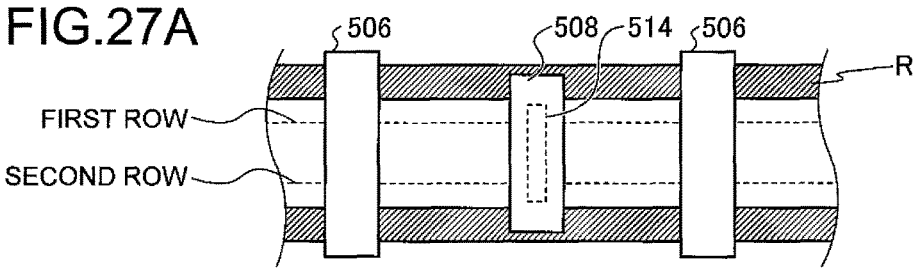
FIGS. 27A to 27D are a set of drawings showing examples of a print head of the printer used for printing on the bundling tape.

For example, in the case where the information is printed on the bundling tape R in two rows, as shown in FIG. 27A, the printer 508, which has a print head 514 that can print information in two rows on the bundling tape R, is used. The first row of information can be printed by one side of the print head 514 and the second row of information can be printed by the other side of the print head 514. In this case, the position of the printer 508 can be fixed, and the bundling tape R can be moved bidirectionally to print the character string thereon; alternatively, the position of the bundling tape R can be fixed, and the printer 508 can be moved bidirectionally to print the character string on the bundling tape R. The broken lines on the bundling tape R shown in FIGS. 27A to 27D correspond to the positions of the two rows of information printed by the print head 514.

Figure 27B:
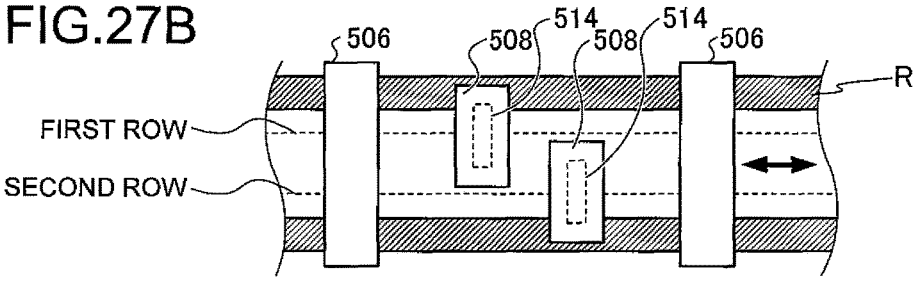

Alternatively, as shown in FIG. 27B, two printers 508, each having one print head 514 that can print a single row of information, can be placed at positions of the rows, and each printer 508 can be used to print each row of character string. In this case, if the two printers 508 have a positional relation such that they are likely to collide if they move, the positions of the printers 508 can be fixed and the bundling tape R can be moved bidirectionally to print the character string thereon. If the two printers 508 will not collide, the printers 508 can be moved to perform the printing.

Figure 27C:
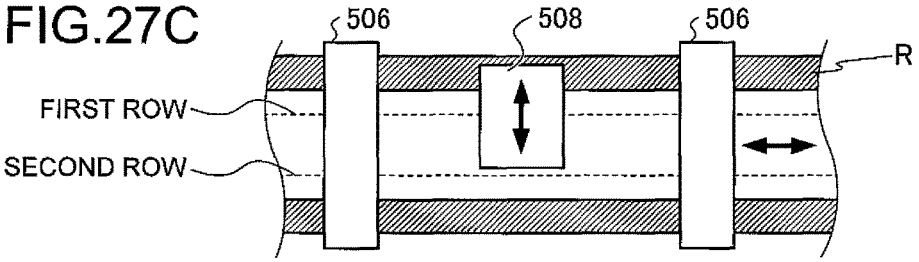

Alternatively, as shown in FIG. 27C, one printer 508 having a print head that can print a single row of information can be used, and printing can be performed by moving the position of the printer 508 in a direction perpendicular to a movement direction of the bundling tape R by the drive rollers 506. In this case, the first row of character string is printed by moving the bundling tape R while the printer 508 is set in the printing position corresponding to the first row. After printing of the first row is completed, the printer 508 is shifted to the printing position corresponding to the second row, and the bundling tape R is wound back by the drive rollers 506 up to the printing start position in the second row. Thereafter, the character string of the second row can be printed by the printer 508 set in the printing position corresponding to the second row.

Figure 27D:
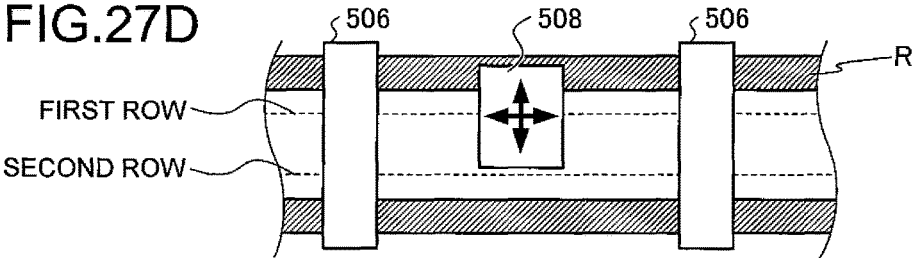

Alternatively, as shown in FIG. 27D, one printer 508 having a print head that can print a single row of information can be used, and printing can be performed by moving the position of the printer 508 in the perpendicular direction as well as a parallel direction to the movement direction of the bundling tape R. In this case, the two rows of information can be printed by keeping the position of the bundling tape R fixed and moving the printer 508.

The number of printers 508 and a structure and operations relating to a movement control of the printer 508 and the bundling tape R for performing printing on the bundling tape R can be appropriately decided according to the size of the apparatus and the constraints imposed by the layout of the constituent elements inside the apparatus, etc.

In the present embodiment, the character string that includes both numeric characters and symbols are printed on the bundling tape. However, the characters printed on the bundling tape need not be limited to numeric characters and symbols; a machine-readable code, such as, a barcode, can be printed instead of or along with the character string. Codes, such as, linear barcode or a two-dimensional barcode can be used to add a lot more information in a limited space as compared to when printing a character string. Apart from a standardized barcode, etc., a unique code can also be used. Because the information included in the unique code can be only recognized by a limited few, the information can be used as security information.

Thus, according to the present embodiment, the wrapping length of the bundling tape R, the blank range in the wrapping length, and the printing area 210 are managed based on the banknote kind of the bundling-object-banknotes P. When bundling the bundling-object-banknotes P with the bundling tape R, the printing area 210 corresponding to the banknote kind of the bundling-object-banknotes P is read from the bundling-tape managing unit 175, and the variable information is printed in the printing area 210 of the bundling tape R based on the read printing area 210. Consequently, the information can be printed in the printing area 210 with awareness regarding the wrapping length and the printing area 210 of the bundling tape R for the bundling-object-banknotes P of each banknote kind.

Furthermore, in the present embodiment, information can be printed on the bundling tape R situated on a single surface side of the banknote bundle. Specifically, for example, the information relating to the date on which the bundling process is performed and the operator who performed the bundling, and information relating to an owner of the apparatus and a place at which the apparatus is installed, such as, the bank where the bundling process is performed, a bank code, and the branch name are printed, and these pieces of information can be viewed at once by looking at a single surface side of the banknote bundle.

Furthermore, in the present embodiment, the information to be printed on the bundling tape R is divided into the variable information, such as, the operator name, and the fixed information, such as, the bank name, and the user can easily modify the variable information, making the operation of the apparatus very convenient. The apparatus is designed not to allow money processing to be performed by an operator who has not been authenticated when the apparatus is started up. Consequently, usage of the apparatus by impersonation can be prevented, and the information of the operator actually using the apparatus can be reliably printed on the bundling tape R.

Furthermore, according to the present embodiment, the printing positions are automatically controlled so that the position where the variable information is printed and the position where the fixed information is printed do not overlap. Consequently, a situation where the information printed on the bundling tape R is unreadable because of overlapped printing of the pieces of information can be avoided.

Furthermore, according to the present embodiment, the variable information that is likely to vary with the user is printed by the printer, and the fixed information that generally does not vary is printed by the imprinting operation of the stamp. Consequently, the time required for the printing operation performed by the printer can be shortened. Furthermore, by using the stamp, a lot of information can be printed on the bundling tape R with a single imprinting operation; consequently, the overall time required for the operation can be reduced.

The constituent elements of the apparatus illustrated are merely conceptual and may not necessarily physically resemble the structures shown in the drawings. The apparatus need not necessarily have the structure that is illustrated.

Furthermore, each processing function performed by the apparatus can be partially performed by a CPU (Central Processing Unit) (or a microcomputer, such as, an MPU (Micro Processing Unit), and an MCU (Micro Controller Unit)), or a computer program executed by the CPU (or the microcomputer, such as, the MPU and the MCU), or by hardware that uses wired logic.

In the banknote bundling apparatus according to the present invention, information is printed on a bundling tape situated on one surface of the banknote bundle thereby realizing enhanced work efficiency. Consequently, this technology is useful, for example, for the banknote bundling apparatuses used in banking establishments, etc.

What is claimed:

1. A banknote bundling apparatus comprising:

a hopper that receives banknotes;

a recognition unit that recognizes a banknote kind of each banknote received by the hopper;

a stacking unit in which bundling-object-banknotes are stacked based on the banknote kind recognized by the recognition unit;

a bundling unit that forms a banknote bundle, the banknote bundle having two opposed faces and four edges and being formed by bundling the stacked bundling-object-banknotes with a bundling tape having a strip area, the bundling unit utilizing the bundling tape to bundle the bundling-object-banknotes stacked in the stacking unit when the number of the bundling-object-banknotes stacked in the stacking unit reaches a predetermined number;

a printing unit that prints a plurality of pieces of information on the bundling tape;

a control unit comprising:

a bundling tape managing unit configured to manage a wrapping length of the bundling tape and positions and dimensions of a printing area of the wrapping length according to the banknote kind;

a printing-area setting unit configured to set the printing area on a portion of the bundling tape situated on one face of the banknote bundle automatically based on the recognized banknote kind of the bundling-object-banknotes, the corresponding wrapping length and printing area from the bundling tape managing unit, and the strip area of the bundling tape;

wherein the control unit automatically controls printing positions of each of the plurality of pieces of information within the printing area based on contents of each piece of information so that all of the plurality of pieces of information are printed on the portion of the bundling tape on the one face of the banknote bundle and not on any of the four edges of the banknote bundle; and wherein the printing area is set on the one face on which ends of the bundling tape are not present after bundling.

2. The banknote bundling apparatus according to claim 1, wherein the plurality of pieces of information includes fixed information of fixed printing length and variable information of variable printing length, the variable information includes operator information identifying an operator using the banknote bundling apparatus, the fixed information includes bank information identifying an owner of the banknote bundling apparatus, and the printing positions within the printing area are controlled based on the printing length.

3. The banknote bundling apparatus according to claim 2, wherein the bank information includes at least one of a bank name of a bank where the banknote bundling apparatus is installed and an identification number of the bank, and, if the bank is a branch, further includes at least one of a branch name and a branch number.

4. The banknote bundling apparatus according to claim 2, wherein the operator information is information selected from among a name of an operator who performed bundling of the banknote bundle, an identification number identifying the operator, and the variable information further includes information selected from among a bundled date of the banknote bundle, a bundled time of the banknote bundle, the banknote kind of the bundling-object-banknotes, and identification information of the stacking unit in which the bundling-object-banknotes were stacked.

5. The banknote bundling apparatus according to claim 2, wherein the printing unit includes a printer for printing the variable information and a stamp for printing the fixed information.

6. The banknote bundling apparatus according to claim 1, wherein the strip area includes at least one of a color and a pattern, and the printing unit prints on the bundling tape the information in the printing area that excludes the at least one of the color and the pattern on the one face.

7. The banknote bundling apparatus according to claim 1 wherein the bundling unit bundles the bundling-object-banknotes with the bundling tape so that both ends of the bundling tape are present on a different one face of the banknote bundle, and the printing area is set on the one face opposite to said different one face.

8. The banknote bundling apparatus according to claim 1 wherein the plurality of pieces of information includes a linear barcode or two-dimensional barcode.

9. A banknote bundling apparatus comprising:

a stacking unit that stacks bundling-object-banknotes;

a bundling unit that forms a banknote bundle, the banknote bundle having two opposed faces and four edges and being formed by bundling the bundling-object-banknotes stacked in the stacking unit with a bundling tape, the bundling tape having a strip area;

a printing unit that prints a plurality of pieces of information on the bundling tape to be used by the bundling unit;

a control unit comprising:

a bundling tape managing unit configured to manage a wrapping length of the bundling tape and positions and dimensions of a printing area of the wrapping length according to a banknote kind;

a printing-area setting unit configured to set the printing area on a portion of the bundling tape situated on one face of the banknote bundle automatically based on a recognized kind of the bundling-object-banknotes, the corresponding wrapping length and printing area from the bundling tape managing unit, and the strip area of the bundling tape;

wherein the control unit automatically controls printing positions of each of the plurality of pieces of information within the printing area based on contents of each piece of information so that all of the plurality of pieces of information are printed on the portion of the bundling tape on the one face of the banknote bundle and not on any of the four edges of the banknote bundle; and wherein the printing area is set on the one face on which ends of the bundling tape are not present after bundling.

10. The banknote bundling apparatus according to claim 9 wherein the bundling unit bundles the bundling-object-banknotes with the bundling tape so that both ends of the bundling tape are present on a different one face of the banknote bundle, and the printing area is set on the one face opposite to said different one face.

11. A banknote bundling apparatus comprising:

a hopper that receives banknotes;

a recognition unit that recognizes a banknote kind of each banknote received by the hopper;

a stacking unit in which bundling-object-banknotes are stacked based on the banknote kind recognized by the recognition unit;

a bundling unit that forms a banknote bundle by bundling with a bundling tape, having a strip area, the bundling-object-banknotes stacked in the stacking unit when the number of the bundling-object-banknotes stacked in the stacking unit reaches a predetermined number;

wherein the banknote bundle has two opposed faces and four edges;

a printing unit that prints a plurality of pieces of information on the bundling tape;

wherein the printing unit is configured to move in a direction perpendicular or parallel to a direction of the movement of the bundling tape to print multiple rows such that all of the pieces of information are printed without overlap; and a control unit comprising:

a bundling tape managing unit configured to manage a wrapping length of the bundling tape and positions and dimensions of a printing area of the wrapping length according to the banknote kind;

a printing-area setting unit configured to set the printing area on a portion of the bundling tape situated on one face of the banknote bundle automatically based on the recognized banknote kind of the bundling-object-banknotes, the corresponding wrapping length and printing area from the bundling tape managing unit, and the strip area of the bundling tape; and wherein the control unit automatically controls printing positions of each of the plurality of pieces of information within the printing area based on contents of each piece of information so that all of the plurality of pieces of information are printed on the portion of the bundling tape on the one face and not on any of the four edges or the other face of the banknote bundle, and viewable without overlapping each other.

12. The banknote bundling apparatus according to claim 11, the printing unit includes:

a first printing unit that prints fixed information of fixed printing length and a second printing unit that prints variable information of variable printing length.

13. The banknote bundling apparatus according to claim 11, wherein while the bundling tape moves under the printing unit, the printing unit moves to print the information in two or more lines.

* * * * *